US005140380A

United States Patent [19]

Nakamura et al.

[11] Patent Number: 5,140,380

[45] Date of Patent: Aug. 18, 1992

[54] IMAGE FORMING APPARATUS WITH BOOK BINDING MECHANISM

[75] Inventors: Shinichi Nakamura, Kawasaki; Tomobumi Nakayama, Tokyo; Osamu Iwamoto, Kawasaki; Satoshi Kuroyanagi, Tokyo; Hisatsugu Tahara, Kawasaki, all of Japan

[73] Assignee: Canon Kabushiki Kaisha, Tokyo, Japan

[21] Appl. No.: 737,840

[22] Filed: Jul. 30, 1991

Related U.S. Application Data

[63] Continuation of Ser. No. 610,276, Nov. 7, 1990, abandoned.

[30] Foreign Application Priority Data

Nov. 9, 1989 [JP] Japan ..... 1-290107
Nov. 9, 1989 [JP] Japan ..... 1-290108

[51] Int. Cl.[5] ..... G03G 15/00

[52] U.S. Cl. ..... 355/324; 270/53; 270/58; 412/6; 412/33; 412/37; 355/311

[58] Field of Search ..... 355/324, 311; 412/6, 412/8, 11, 14, 18, 28, 33, 37, 902; 270/37, 53, 58

[56] References Cited

U.S. PATENT DOCUMENTS

| | | | |
|---|---|---|---|
| 3,709,595 | 1/1973 | Turner et al. | 355/324 |
| 3,793,016 | 2/1974 | Eichorn | 412/33 X |
| 4,143,672 | 1/1979 | Burlew et al. | 412/6 X |
| 4,361,393 | 11/1982 | Noto | 355/324 |
| 4,368,972 | 1/1983 | Naramore | 355/324 |
| 4,444,491 | 4/1984 | Rinehart et al. | 355/324 X |
| 4,511,297 | 4/1985 | Wilson et al. | 412/8 |
| 4,522,542 | 6/1985 | Minor | 412/14 X |
| 4,540,458 | 9/1985 | Baughman et al. | 412/8 X |
| 4,549,804 | 10/1985 | Braun et al. | 355/324 |
| 4,564,185 | 1/1986 | Hamlin et al. | 412/33 X |
| 4,568,172 | 2/1986 | Acquavana | 355/324 X |
| 4,586,640 | 5/1986 | Smith | 412/37 X |
| 4,603,971 | 8/1986 | Kukucka et al. | 355/324 X |
| 4,611,741 | 9/1986 | Wilson | 412/37 X |
| 4,626,156 | 12/1986 | Baughman et al. | 412/33 |
| 4,640,611 | 2/1987 | Ohdake et al. | 355/324 X |
| 4,763,167 | 8/1988 | Watanabe et al. | 355/324 |
| 4,795,071 | 1/1989 | Jacobs et al. | 412/6 X |
| 4,797,048 | 1/1989 | Doery | 412/11 |
| 4,811,048 | 3/1989 | Ishikawa et al. | 355/324 |
| 4,828,645 | 5/1989 | Van Bortel | 56/384 |
| 4,864,350 | 9/1989 | Ishiguro et al. | 355/324 X |
| 4,891,681 | 1/1990 | Fiske et al. | 355/324 X |
| 4,893,152 | 1/1990 | Ishiguro et al. | 412/33 X |
| 4,901,994 | 2/1990 | Ishiguro et al. | 270/53 |
| 4,917,366 | 4/1990 | Murakama et al. | 270/53 |
| 4,930,761 | 6/1990 | Naito et al. | 270/53 |
| 4,965,629 | 10/1990 | Hiroi et al. | 355/324 X |
| 4,974,823 | 12/1990 | Ishiguro et al. | 270/53 |
| 4,986,520 | 1/1991 | Shido et al. | 270/53 |
| 4,988,030 | 1/1991 | Muramatu et al. | 270/53 X |
| 4,993,697 | 2/1991 | Yamashita et al. | 270/53 |
| 5,014,092 | 5/1991 | Kubo et al. | 355/324 |

*Primary Examiner*—R. L. Moses
*Attorney, Agent, or Firm*—Fitzpatrick, Cella Harper & Scinto

[57] ABSTRACT

An image forming apparatus has a book binding mechanism for performing a book bind operation using front sheets of a plurality of sizes which can bind a bundle of sheet members recorded by said image forming apparatus, and have limitations on the numbers of recorded sheet members to be bound. The image forming apparatus further has output means for outputting sheet number data according to a bundle of sheet members; judge means for judging whether or not the sheet number data output from said output means is larger than a range of the limitation; detect means for, when the judged result from said judge means is affirmative, dividing the sheet number data, and detecting a divided sheet number value which falls within the range of the limitation; and control means for controlling to perform a book bind operation in units of the sheet numbers detected by said detect means.

14 Claims, 16 Drawing Sheets

FIG. 9

| DATA CONTENT | |
|---|---|
| 1 | 601 BIND MODE FLAG |
| 0 | 602 MANUAL BIND MODE FLAG |
| 0 | 603 GROUP MODE FLAG |
| 0 | 604 SORT MODE FLAG |
| 0 | 605 NORMAL MODE FLAG |
| 5 | 606 SHEET NUMBER OF ORIGINAL |
| 001 | 607 SIZE OF SHEET |
| 2 | 608 COPY NUMBER |
| 500 | 609 THICKNESS DATA |
| 001 | 610 FRONT SHEET DATA |
| 1 | 611 LEFT BIND MODE FLAG |
| 0 | 612 SINGLE BIND MODE FLAG |
| 0 | 619 START FLAG |
| — | 618 FRONT PAGE SET |
| — | 613 EMPTY FLAG |
| — | 614 END FLAG |
| 000000001 | 615 FRONT PAGE SIZE AND THICKNESS CODE OF UPPER STAGE |
| 000001001 | 616 FRONT PAGE SIZE AND THICKNESS CODE OF INTERMEDIATE STAGE |
| 000010001 | 617 FRONT PAGE SIZE AND THICKNESS CODE OF LOWER STAGE |
| | |

IMAGE FORMING APPARATUS WITH BOOK BINDING MECHANISM

This application is a continuation of application Ser. No. 610,276 filed Nov. 7, 1990, now abandoned.

BACKGROUND OF THE INVENTION

1. Field of the Invention

The present invention relates to an image forming apparatus such as a copying machine and, more particularly, to an image forming apparatus with a book binding mechanism capable of binding recording sheets recorded.

2. Related Background Art

As a conventional post-treatment apparatus for an image forming apparatus such as a copying machine, a book binding mechanism for binding a bundle of recorded transfer sheets (recording sheets) using a stapler, or the like is known. Such a versatile book binding mechanism, however, cannot automatically bind copied transfer sheets. The present applicant proposed an image forming apparatus with a book binding mechanism, which can automatically bind copied transfer sheets, on the same filing date as the present invention (Japanese Patent Application No. 1-290103).

However, in this proposal, the number of transfer sheets in a bundle to be bound with a front sheet is limited.

SUMMARY OF THE INVENTION

The present invention has been made in consideration of the above situation, and has as its object to provide an image forming apparatus with a book binding mechanism which, even if the number of transfer sheets to be bound exceeds that which can be bound at a time in a book binding mechanism, can bind these transfer sheets in a plurality of operations.

In order to achieve the above object, according to the present invention, there is provided an image forming apparatus which comprises a book binding mechanism which selects one of a plurality of sizes of front sheets which can bind a bundle of sheet members recorded by the image forming apparatus, and have a limitation on the number of recorded sheet members to be bound. in correspondence with the size of the sheet members, comprising output means for outputting sheet number data according to a bundle of sheet members, judge means for judging whether or not the sheet number data output from the output means is larger than a range of the limitation, detect means for, when the judged result from the judge means is affirmative, dividing the sheet number data, and detecting a divided sheet number value which falls within the range of the limitation, and means for controlling to bind a book in units of the sheet numbers detected by the detect means.

The apparatus of the present invention further comprises alarm means for, when the divided sheet number value cannot fall within the range of the limitation, generating an alarm, and prohibiting a book bind treatment of the book binding mechanism.

Record means of the present invention copies an original on a recording sheet, and the output means comprises count means for counting the number of sheets of the original.

According to the present invention, the judge means and detect means detect the number of recording sheets which can be bound on the basis of the number of recording sheets in a bundle output from the output means. The bundle of recording sheets is divided in units of the numbers of recording sheets which can be bound, and the divided recording sheets are fed to the book binding mechanism. Therefore, the book binding mechanism can execute the book bind treatment in units of recorded recording sheets which are divided. When the divided sheet number value cannot fall within the range of limitation, the alarm means generates an alarm, and the book bind treatment is prohibited. Therefore, a book binding error can be prevented. Furthermore, since the output means comprises the means for counting the number of original sheets, a divisional book bind treatment can be performed in correspondence with the number of original sheets.

According to the present invention, a proper front sheet according to the number of original sheets can be automatically selected, and even when the number of original sheets exceeds one which can be bound, a divisional book bind treatment can be performed. When the divisional book bind treatment cannot be performed, an alarm is generated, and the book bind treatment is prohibited, thus preventing a book binding error.

In addition, since the image forming apparatus of the present invention comprises input means for inputting a size of a front sheet to be bound, a plurality of recording sheet deposit means, detachable from the image forming apparatus main body, for respectively depositing recording sheets having different sizes, record means for selectively picking up the recording sheets having a size according to the size input from the input means, and recording an image thereon, a plurality of front sheet deposit means for respectively depositing front sheets having different sizes, and book bind means for selectively picking up a front sheet having a size input from the input means, and binding the recording sheets discharged from the record means in the selected front sheet. Therefore, an operator need only input a size of a front sheet to be bound at the input means, and the recording sheets corresponding to the size of a front sheet can be automatically selected by the record means. As a result, since the sizes of the recording sheets and the front sheet can coincide with each other, the book bind treatment can be automatically executed.

The apparatus of the present invention also comprises a first detection portion for detecting an original size, a first judgement portion for judging whether or not the detected original size is the same as the front sheet size input from the input means, and a magnification change recording portion for, when the judged result of the first judgement portion is negative, performing magnification change recording of the original on the recording sheet in correspondence with the size of the recording sheets to be recorded. Therefore, even when the original size is different from the input front sheet size, magnification change recording is automatically executed. Thus, the book bind treatment using various front sheets can be performed regardless of the original size.

The apparatus of the present invention also comprises a second detection portion for detecting the sizes of recording sheets in the plurality of recording sheet deposit means, and a second judgement portion for judging whether or not the detected recording sheet size does not coincide with the front sheet size input from the input means and the recording sheet size is larger than the front sheet size. The image forming apparatus or the book binding mechanism further comprises sheet folding means for, when the judged result of the second judgement portion is affirmative, folding the recording sheets recorded by the record means to have the same size as the front sheet size input from the input means.

Even when there are no recording sheets corresponding to the front sheet size, if there are larger recording sheets, the recording sheets are folded by the sheet folding means. Therefore, the recording sheets need not be prepared in correspondence with the front sheet sizes.

The apparatus of the present invention further comprises a third detection portion for detecting the sizes of the recording sheets in the recording sheet deposit means, a third judgement portion for judging whether or not the detected recording sheet size coincides with the front sheet size input from the input means, and alarm means for, when the judged result of the third judgement means is negative, generating an alarm. Therefore, when there are no recording sheets corresponding to the front sheet size, an alarm is generated by the alarm means, and an erroneous treatment due to an operation error of an operator can be avoided.

BRIEF DESCRIPTION OF THE DRAWINGS

FIG. 9 is an explanatory view showing the types of information to be transferred from the copying machine to the book bind device;

DESCRIPTION OF THE PREFERRED EMBODIMENTS

An embodiment of the present invention will be described below with reference to the accompanying drawings.

Figure 1:
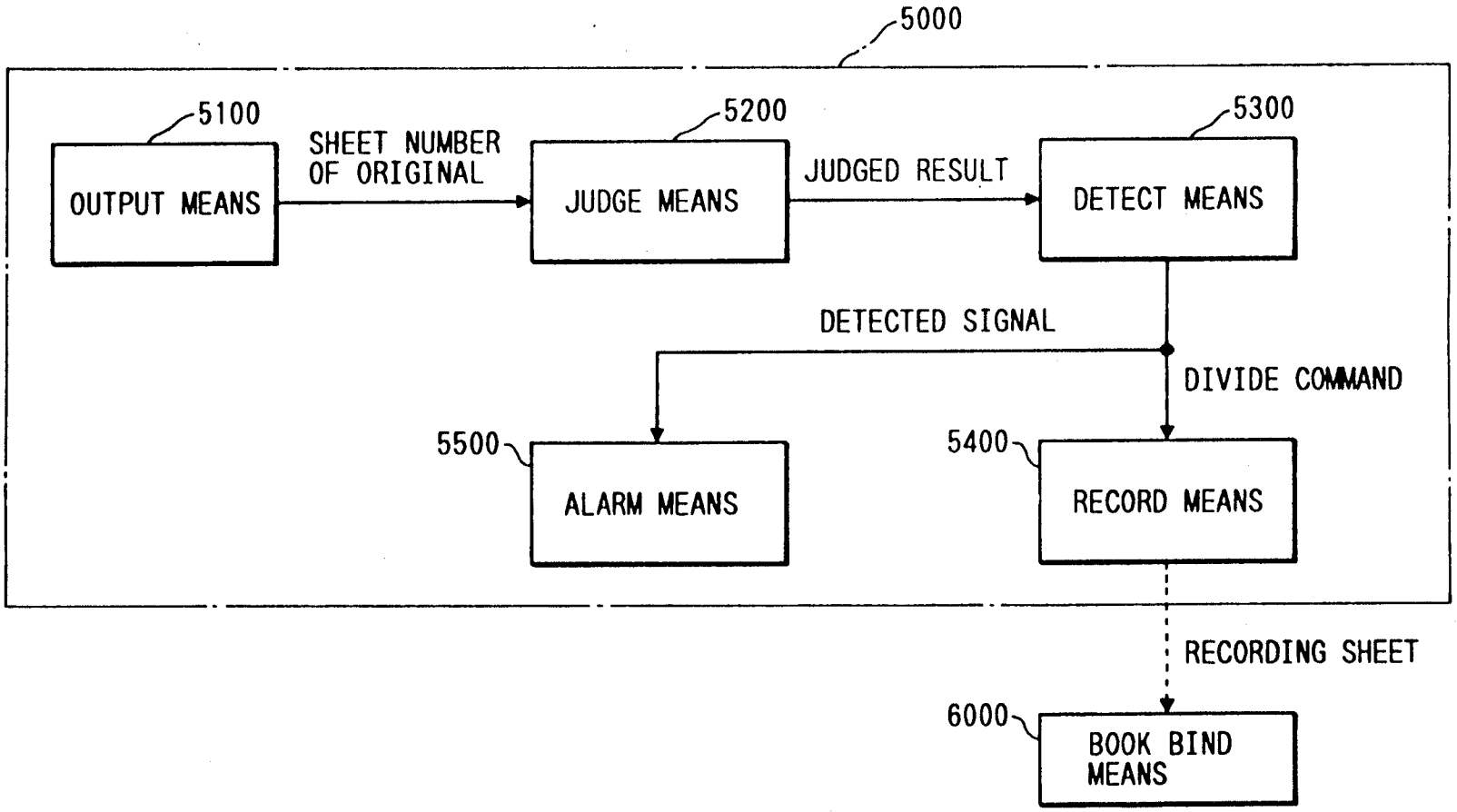
FIG. 1 is a block diagram showing a basic arrangement of an embodiment of the present invention.

FIG. 1 shows a basic arrangement according to an embodiment of the present invention.

In FIG. 1, a book bind means 6000 can bind a bundle of recording sheets recorded by an image forming or recording apparatus 5000, and selectively binds the bundle of recording sheets in one of a plurality of sizes of front sheets which have limitations on the number of recorded recording sheets to be bound.

The image recording apparatus 5000 includes an output means 5100 for outputting sheet number data according to a bundle of recording sheets, a judge means 5200 for judging whether or not the sheet number data output from the output means is larger than a range of the limitation, a detect means 5300 for, when the judged result of the judge means is affirmative, dividing the sheet number data, and detecting a divided sheet number value which falls within the range of the limitation.

The apparatus 5000 also includes a record means 5400 for recording images in units of the sheet numbers detected by the detect means, and an alarm means 5500 for, when the divided sheet number value cannot fall within the range of the limitation, generating an alarm, and prohibiting a book bind treatment of the book bind means. Note that the record means copies an original on recording sheets, and the output means comprises a count means for counting the number of original sheets.

Figure 2:
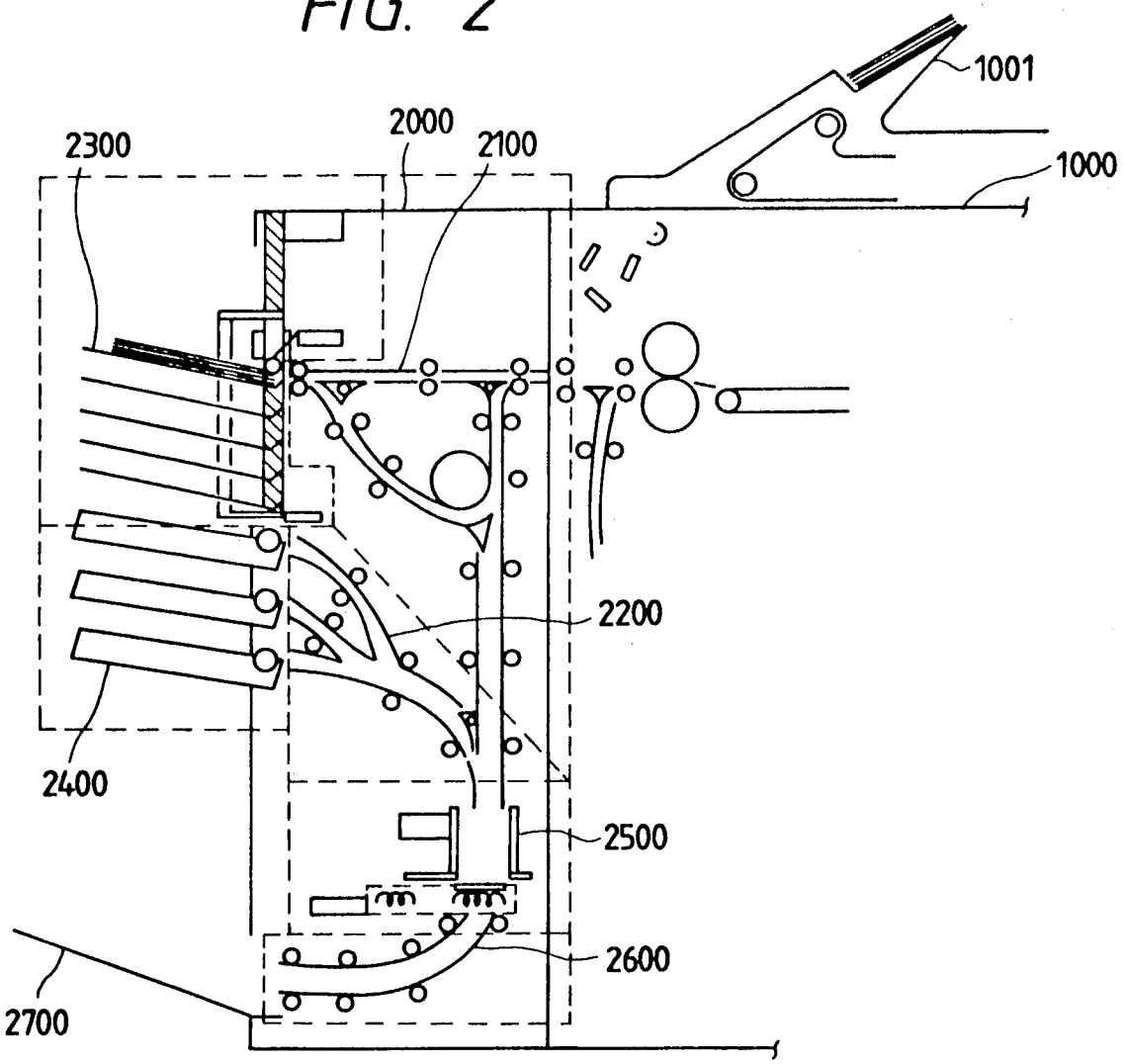
FIG. 2 is a sectional view showing a structure of a main part of the embodiment of the present invention.

Prior to the detailed description of the present invention, the overall apparatus will be described below with reference to FIG. 2 showing the basic arrangement of the apparatus according to the embodiment of the present invention.

In FIG. 2, a copying machine main body 1000 selectively picks up a transfer sheet having the same size as a front sheet size instructed by an operator, and copies an original thereon. As the copying machine main body 1000 capable of performing magnification change recording, a laser printer for exposing a photosensitive drum with a laser beam to form a latent image on the photosensitive drum is employed. Transfer sheet cassettes having different sizes can be detachably loaded in the copying machine main body 1000. Each transfer sheet cassette has a recess indicating the size of transfer sheets to be deposited, and when a microswitch detects this recess, the size of transfer sheets can be identified.

The copying machine main body 1000 detects the width and length of an original using a photosensor (not shown), thus detecting the size of the original. The copying machine main body 1000 is connected to an original treatment device 1001. The original treatment device 1001 supplies original sheets to an image reading position of the copying machine main body 1000 in synchronism with a copy treatment of the copying machine main body 1000.

A book bind device 2000 includes a first convey unit 2100 for conveying a transfer sheet fed from the copying machine main body 1000, and a second convey unit 2200 for supplying a front sheet from a front sheet cassette 2400 to a book bind unit 2500. The two convey units serve as convey means. The book bind device 2000 also includes an exclusive tray 2300 for temporarily storing transfer sheets, the front sheet cassette 2400 for storing front sheets, and the book bind unit 2500 for binding the transfer sheets with the front sheet by gluing. The book bind unit 2500 comprises a book binder 2503 and a heating unit 2505. The book bind device 2000 further includes a cooling unit 2600 for cooling a heated and glued spine of a book, and a book bind tray 2700 for storing the bound transfer sheets.

Figure 3:
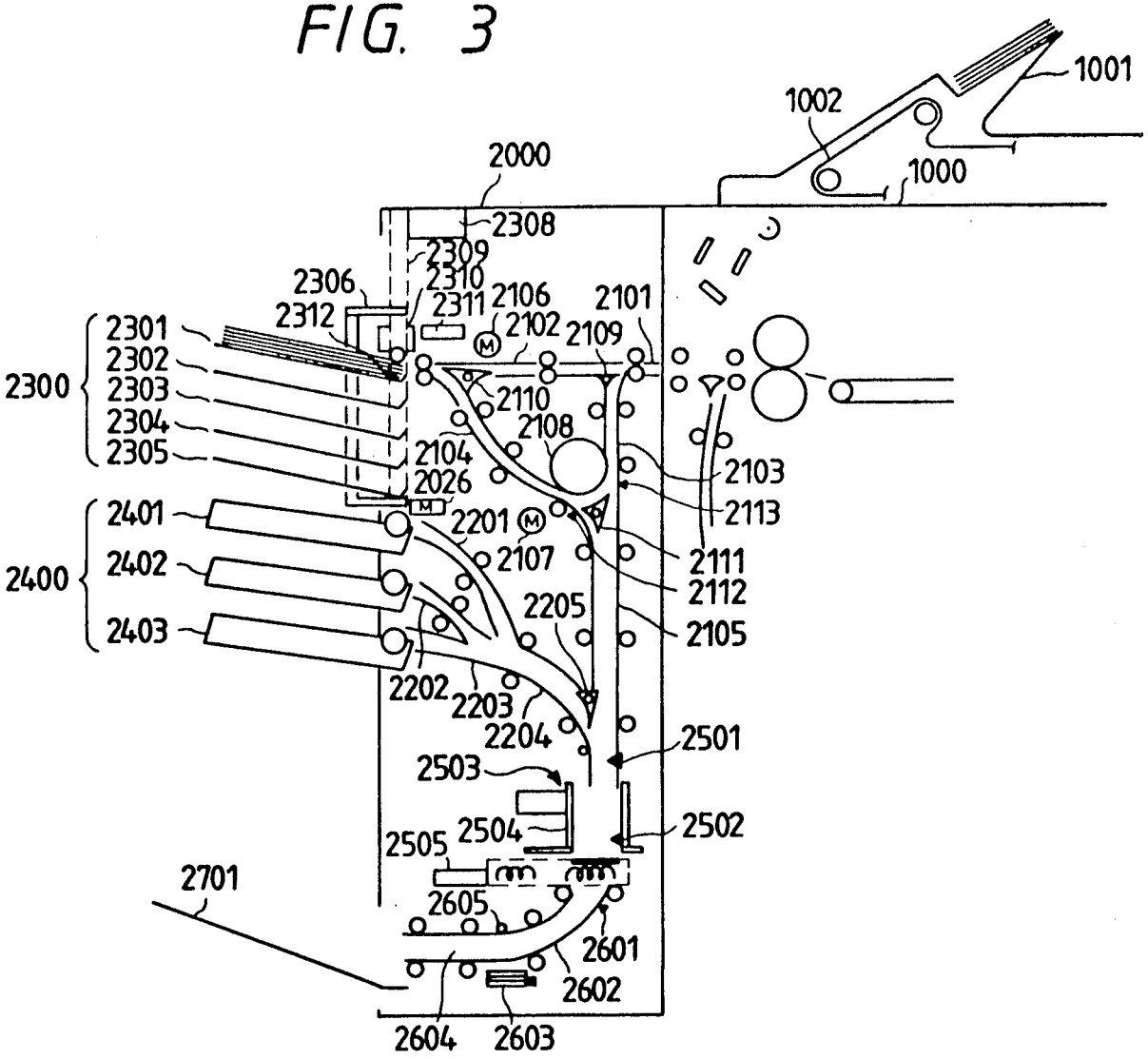
FIG. 3 is a sectional view showing the detailed structure of the main part shown in FIG. 1.

FIG. 3 shows the detailed arrangement in the units of the book bind device 2000 shown in FIG. 2.

In FIG. 3, the original treatment device 1001 comprises a convey path 1002 for conveying an original. A flapper 2109 of the book bind device (book bind means) 2000 switches a convey direction of recorded transfer sheets between a direction of a convey path 2102 and a direction of a convey path 2103. The flapper 2109 is normally set on the convey path 2102 side, and the transfer sheets travel along the convey path 2102. The convey path 2102 is driven by a first convey motor 2106 at the same convey speed as the copying machine main body.

A flapper 2110 selectively switches a convey direction between a convey direction to temporary store bins 2301 to 2305 and a convey direction of a convey path 2104. In a state illustrated in FIG. 3, the convey direction of the flapper 2110 is set in the direction of the temporary store bins 2301 to 2305. For this reason, the transfer sheets discharged from the copying machine main body 1000 are conveyed to the temporary store bins.

A sheet re-supply roller 2311 re-supplies a bundle of transfer sheets stored in one of the temporary store bins into the book bind device. When the transfer sheets are conveyed to the above-mentioned temporary store bins, the sheet re-supply roller 2311 escapes to a position above the temporary store bins. When the first transfer sheet of a second copy is to be received the temporary store bin 2302 is shifted upward by one stage by a lead cam 2309 and a motor 2308, and is set along the convey path 2102.

When the second transfer sheet of a first copy is to be received, the lead cam 2309 is rotated in the reverse direction to shift the bin 2302 in the reverse direction (downward), thus setting the bin 2301 along the convey path 2102. For example, when two copies of transfer sheets (each copy consists of five sheets) are to be received, the lead cam 2309 is moved under the operation control of the motor, so that the transfer sheets of the first copy are received by the temporary store bin 2301 and the transfer sheets of the second copy are received by the bin 2302, thus forming bundles of five sheets by these bins. A swing rod 2306 is arranged to register the side edge portions of these bundles of transfer sheets. The swing rod 2306 is moved by a driving motor 2307 (not shown) to be brought into contact with the transfer sheets, thereby registering the side edge portions of the two bundles.

The bundles of five transfer sheets whose edge portions are registered in this manner are stapled by a staple device 2310 prior to conveyance. The staple device 2310 escapes from the temporary store bins at times other than in a staple mode. The stapled bundles of transfer sheets are fed onto the convey path 2104 by the re-supply roller 2311.

On the other hand, front sheet cassettes 2401 to 2403 are detachable from the book bind device 2000, and store front sheets of different sizes.

In this embodiment, the cassette 2401 stores front sheets for one to five A4-size sheets per bundle, the cassette 2402 stores front sheets for six to 10 A4-size sheets per bundle, and the cassette 2403 stores front sheets for 11 to 20 A4-size sheets per bundle. For example, in each cassette, a plurality of laid U-shaped front sheets are stacked and deposited, and are separated and fed one by one by, e.g., a suction roller. Alternatively, folded and flattened front sheets may be stored, may be separated one by one in a flat state, and then may be spread in a U shape by suction in the book bind unit.

Convey paths 2201 to 2203 for conveying front sheets from the front sheet cassettes 2401 to 2403 merge at a convey path 2204, and convey the front sheets into the book binder 2503.

Each of the convey paths 2201 to 2203 is independently driven by a driving motor 2107, and the convey path to be driven is selected to select a front sheet suitable for a transfer sheet.

The driving motor 2107 independently drives not only the convey paths 2201 to 2203 but also the convey paths 2103 to 2105, 2602 and 2604 through a transmission mechanism (not shown).

A front sheet set sensor 2502 arranged in the book binder 2503 detects that the front sheet is conveyed into the book binder 2503, and a heater of the heating unit 2505 is heated to melt a glue applied on the spine of the front sheet via a copper plate 2533 (not shown).

When the arrival of the front sheet is detected by the front sheet set sensor 2502, the re-supply roller 2311 is driven, and the re-supply path flapper 2110 is switched to the convey path 2104 side. For this reason, the stapled bundles of transfer sheets are conveyed from the convey path 2104 to the book binder 2503 via a convey path 2105. A flapper 2111 arranged at a diverging point to the convey paths 2103 and 2104 switches between these convey paths 2103 and 2104, and guides a bundle of transfer sheets whose transfer copy number is a single copy to the book binder 2503 via the convey path 2103.

One side surface 2504 of the book binder 2503 is movable, and is positioned so that an interval between itself and the other surface is slightly larger than a total height of a bundle of transfer sheets.

The bundle of transfer sheets and the front sheet set in the book binder 2503 are bound by a melted glue. When the heating unit 2505 is moved to escape, the bound bundle is conveyed to the convey path 2602. A fan 2603 is arranged near the convey path 2604 to cool the bundle conveyed from the convey path 2602 along the convey path 2604 below a predetermined temperature, thereby hardening the glue.

The bundle reaching the predetermined temperature is re-conveyed from the convey path 2604 to a book bind tray 2701, and is then discharged.

On the other hand, when the trailing end of the bound bundle is detected by a sensor 2601 arranged near an exit of the book binder 2503, the escaping heating unit 2505 is returned to its home position to prepare for the book bind treatment for the next bundle.

When it is detected that the bound bundle is discharged from the book binder 2503, the bin 2301 which is presently set at the discharge position is shifted upward by the lead cam 2309, and the bin 2302 storing the bundle of the second copy is connected to the convey path 2104. At the same time, a front sheet is fed from the front sheet cassette 2401.

Thereafter, after the arrival of the front sheet in the book binder 2503 is detected by the front sheet set sensor 2502 like in book binding of the first copy described above, the stapled bundle of transfer sheets as the second copy are conveyed from the bin 2302 to the book binder 2503, and are bound.

Figure 4:
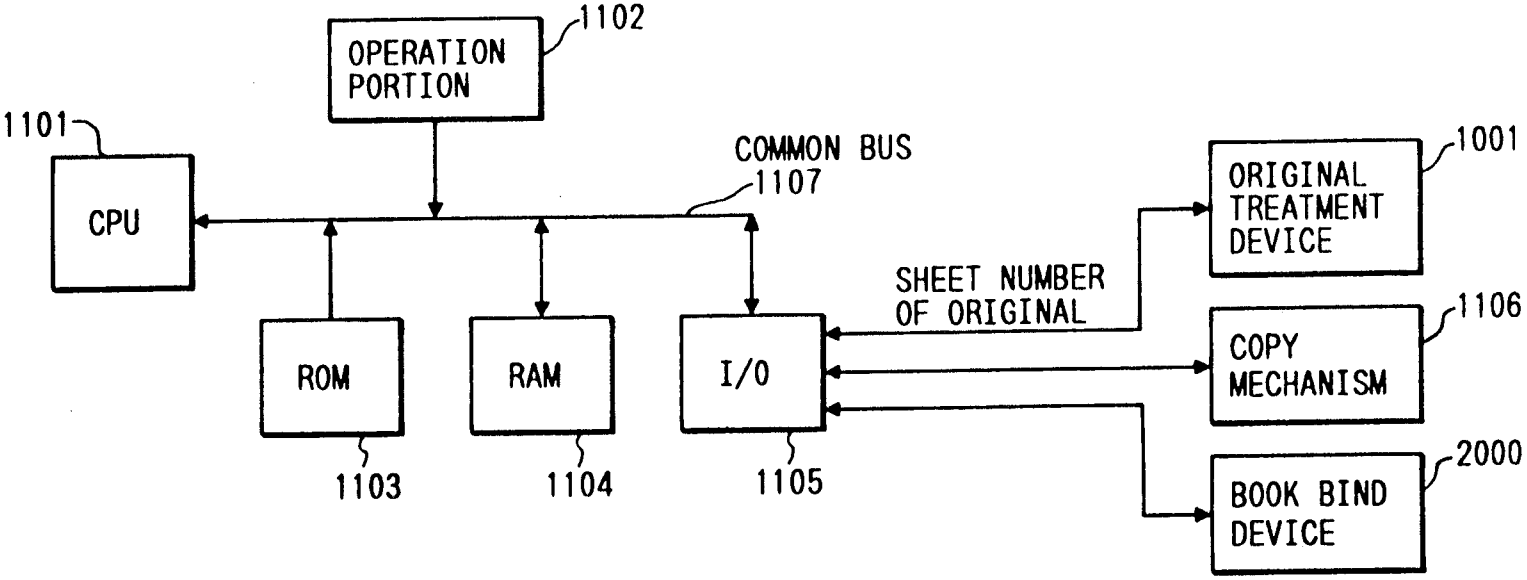
FIG. 4 is a block diagram showing a circuit arrangement of a control system of a copying machine main body according to the embodiment of the present invention.

FIG. 4 shows a circuit arrangement of a control system of the copying machine 1000 shown in FIG. 2.

In FIG. 4, a CPU 1101, an operation portion 1102, a read-only memory (ROM) 1103, a random-access memory (RAM) 1104, and an input/output interface (I/O) 1105 are connected to a common bus. The CPU 1101 controls the overall copying machine. The CPU 1101 executes not only a normal copy treatment, but also a control procedure shown in FIGS. 7A and 7B and FIG. 8 in a book bind mode, thereby executing the following copy treatment associated with the present invention.

a) The CPU 1101 compares the number of original sheets counted by the original treatment device 1001 (count means) with the number of original sheets which can be bound, and when the counted number of original sheets exceeds the number of transfer sheets which can be bound, the CPU executes control for performing divisional copy operations while dividing original sheets to be copied into a proper number of copies.

b) When no proper front sheets for performing the divisional copy operation are set, the CPU 1101 generates an alarm for an operator by means of a display or sound, cancels the book bind mode, and prohibits the book bind treatment.

The CPU 1101 operates as a judgement means and a detection means. The operation portion 1102 has various input keys (to be described later), and inputs information associated with the copy treatment. The ROM 1103 stores a control sequence executed by the CPU 1101, and also stores parameters used in an arithmetic treatment of the CPU 1101. The RAM 1104 temporarily stores arithmetic data of the CPU 1101 and image data read from an original.

The I/O 1105 is connected to the original treatment device 1001, a copy mechanism 1106 in the copying machine, and the book bind device 2000. Information is exchanged between these devices and the CPU 1101.

Various keys, arranged on the operation portion 1102 of the copying machine main body 1000, for issuing operation commands to the copying machine main body 1000 and the book bind device 2000 and their command contents will be described below with reference to FIGS. 5A to 5D showing the outer appearance of the operation portion.

Figure 5A:
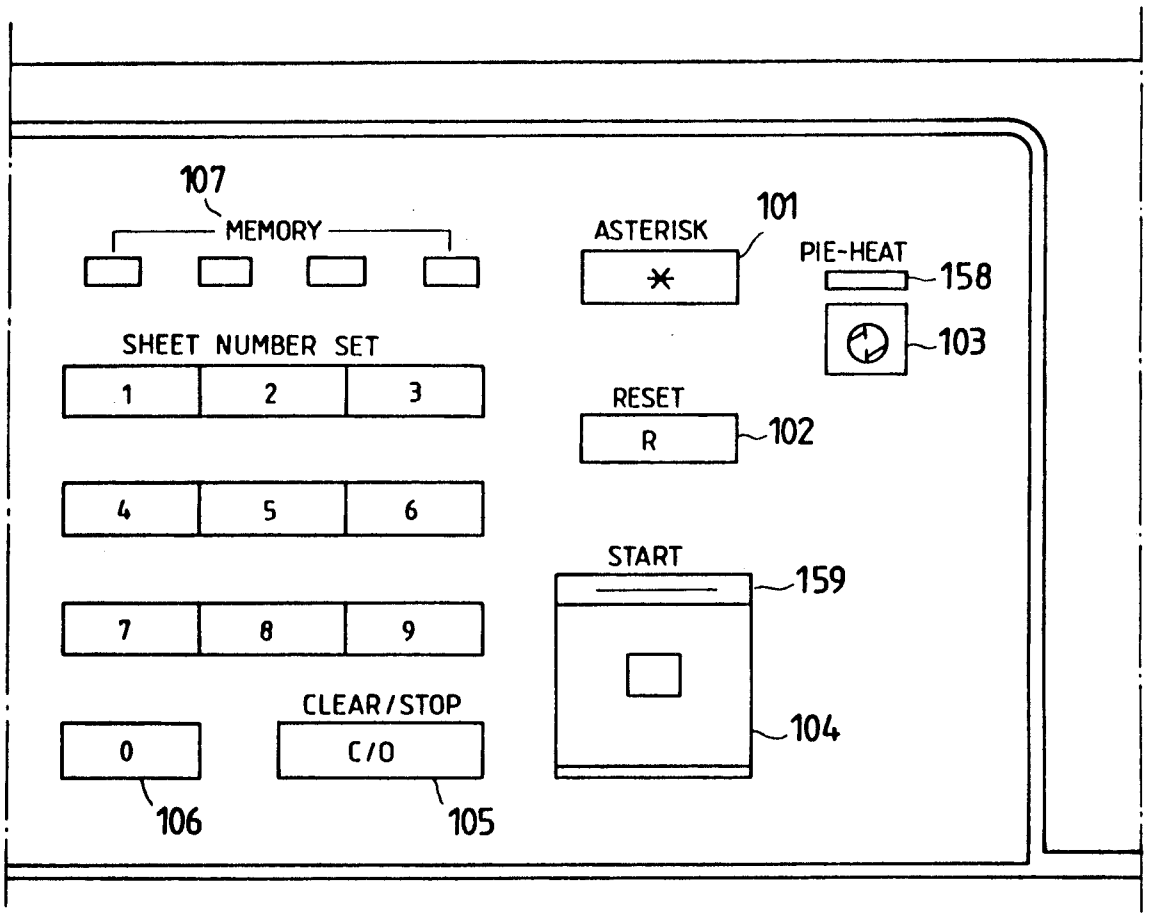
FIGS. 5A to 5D are front views showing key arrangements of an operation portion according to the embodiment of the present invention.

In FIG. 5A, an * (asterisk) key 101 is used by an operator in setting modes for setting, e.g., a bind margin amount, an original frame erase size, and the like. An all-reset key 102 is depressed when an operation mode is reset to a standard mode.

A pre-heat key 103 is depressed to set the overall device in a pre-heat state or to cancel the pre-heat state. The pre-heat key 103 is also depressed when the device is resumed from an auto shut-off state to the standard mode. A copy start key 104 is depressed to start a copy operation.

A clear/stop key 105 is used as a clear key in a standby state, and is also used as a stop key during a copy operation. The clear key is depressed to cancel the set copy sheet number. The clear key is also used to cancel the * (asterisk) mode. The stop key is depressed to interrupt a continuous copy operation. In this case, the copy operation is stopped after a copy operation at the time of depression is completed.

A ten-key pad 106 is used to set a copy sheet number. The ten-key pad 106 is also used to set the * (asterisk) mode. The ten-key pad 106 is also used when the sheet number is set in a manual insertion book bind mode. Memory keys 107 are used by an operator to register modes to be frequently used.

Figure 5B:
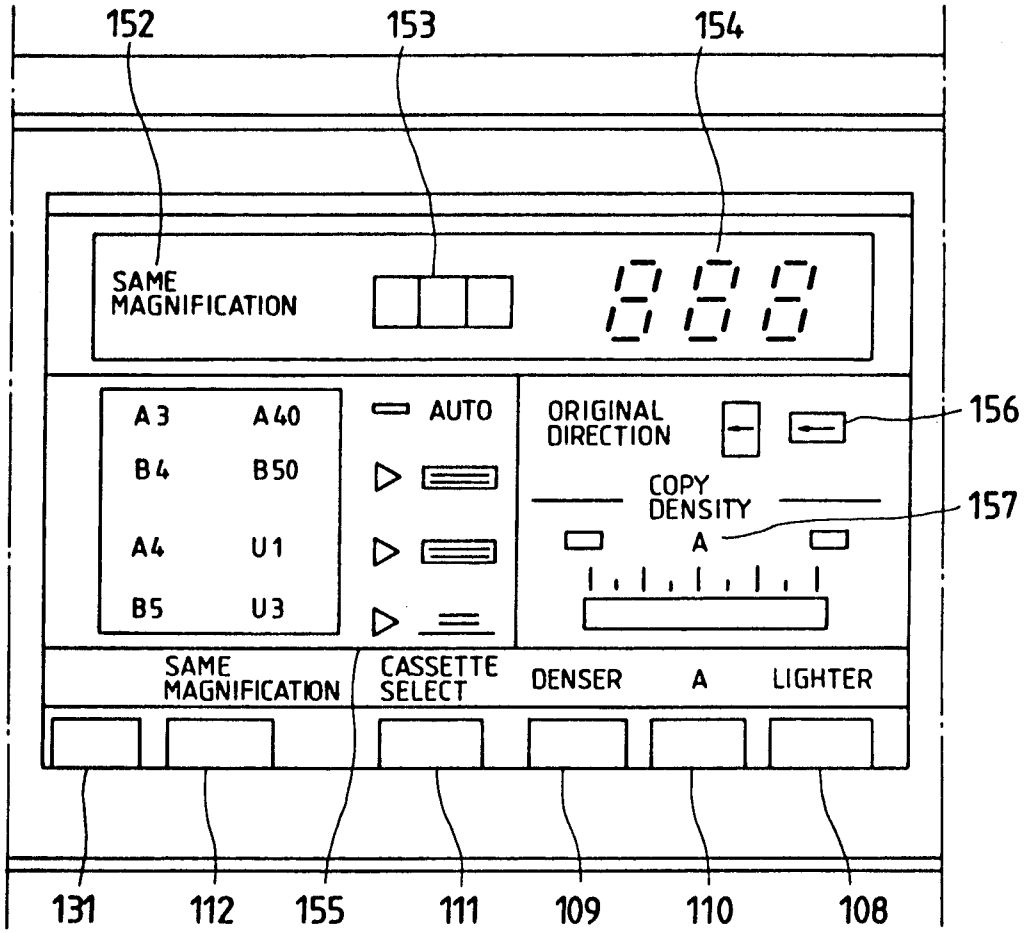

In FIG. 5B, copy density keys 108 and 109 are depressed to manually adjust a copy density. An AE key 110 is depressed when a copy density is automatically adjusted according to the density of an original or when an AE (automatic density control) mode is canceled to a manual mode.

A cassette select key 111 is depressed when an upper cassette 18, a lower cassette 19, or a lower paper deck 20 is selected. When an original is set on an automatic original feeder 35, an APS (automatic paper selector) can be selected. A same magnification key 112 is depressed when a copy operation is performed at the same magnification (original size).

Figure 5C:
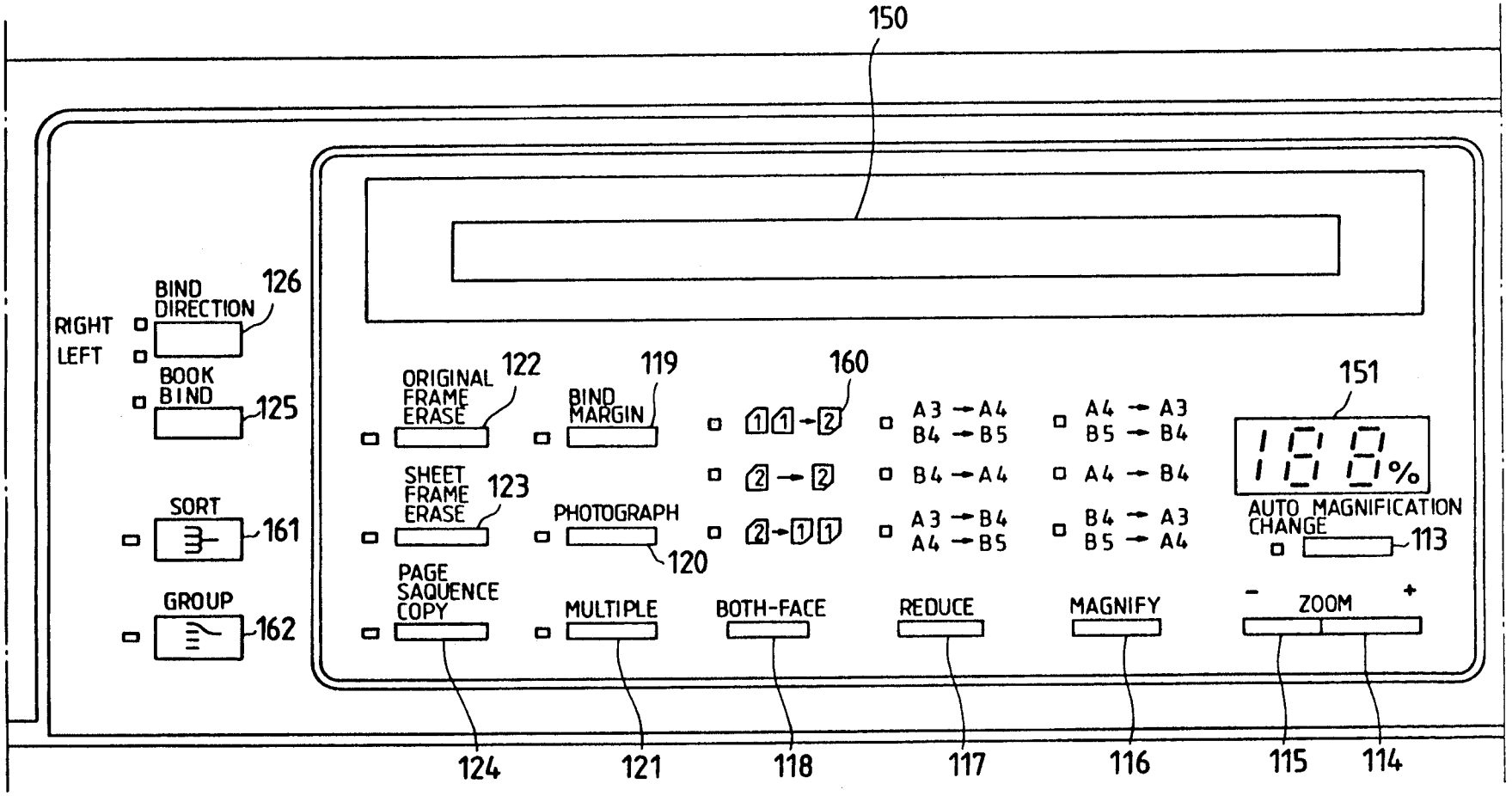

In FIG. 5C, an auto magnification change key 113 is depressed to automatically reduce or magnify the size of an original in correspondence with the designated copy sheet size. Zoom keys 114 and 115 are depressed to set an arbitrary magnification between 64% and 142%. Fixed magnification keys 116 and 117 are depressed to reduce or magnify the size at a fixed magnification.

A both-face key 118 is depressed to perform a both-face copy operation of a single-face original, or a both-face copy operation of a both-face original, or a single-face copy operation of a both-face original. A bind margin key 119 is depressed to form a bind margin having a designated length on the left side of a transfer sheet.

A photograph key 120 is depressed to copy a photograph original. A multiple key 112 is depressed to form an image on the same face of a transfer sheet based on two original sheets.

An original frame erase key 122 is depressed by an operator to perform a fixed size original frame erase operation, and the size is set by the * key. A sheet frame erase key 123 is depressed to erase a frame in correspondence with a cassette size.

A page sequence copy key 124 is depressed to copy right and left pages of an original on different sheets. Both-face copy indicators 160 are turned on when one of a both-face copy mode from a both-face original, and a both-face copy mode from a single-face original is selected.

A book bind key 125 is depressed to operate the device in the book bind mode. A bind direction select key 126 is depressed to select a right or left bind mode. A sort key 161 is turned on in the standard mode when a sorter is added. The sort key 161 is depressed to cancel or set a sort mode.

A group key 162 is depressed to form a plurality of copies of one original, and to store them in units of temporary store bins of the book bind device. An LCD (liquid crystal display) message display 150 is a semi-transmission type liquid crystal display which defines one character by 5×7 dots, and corresponds to 40 characters, and uses two colors as backlight. The message display 150 is normally illuminated by green backlight, and is illuminated by orange backlight in an abnormal state or a copy disable state. When a front sheet selection key 127 is depressed, the message display 150 displays a thickness of a front sheet stored in the designated front sheet cassette. A magnification display 151 displays a set magnification in units of %.

Referring back to FIG. 5B, a same magnification indicator 152 is turned on when the same magnification is selected. Color developing unit indicators are denoted by numeral 153. A copy sheet number display 154 displays a copy sheet number or a self-diagnosis code.

Use cassette indicators 155 indicate a selected one of upper, intermediate, and lower cassettes, and a deck. An original direction indicator 156 indicates a set direction of an original (longitudinal or lateral set). An AE indicator 157 is turned on when the AE (automatic density control) mode is selected.

Referring back to FIG. 5A, a pre-heat indicator 158 is turned on when the pre-heat state is set, and flickers in the auto shut-off state. A ready/wait indicator 159 has green and orange LEDs, and is turned on in green in a ready state (copy enable state) or in orange in a wait state (copy disable state).

Figure 5D:
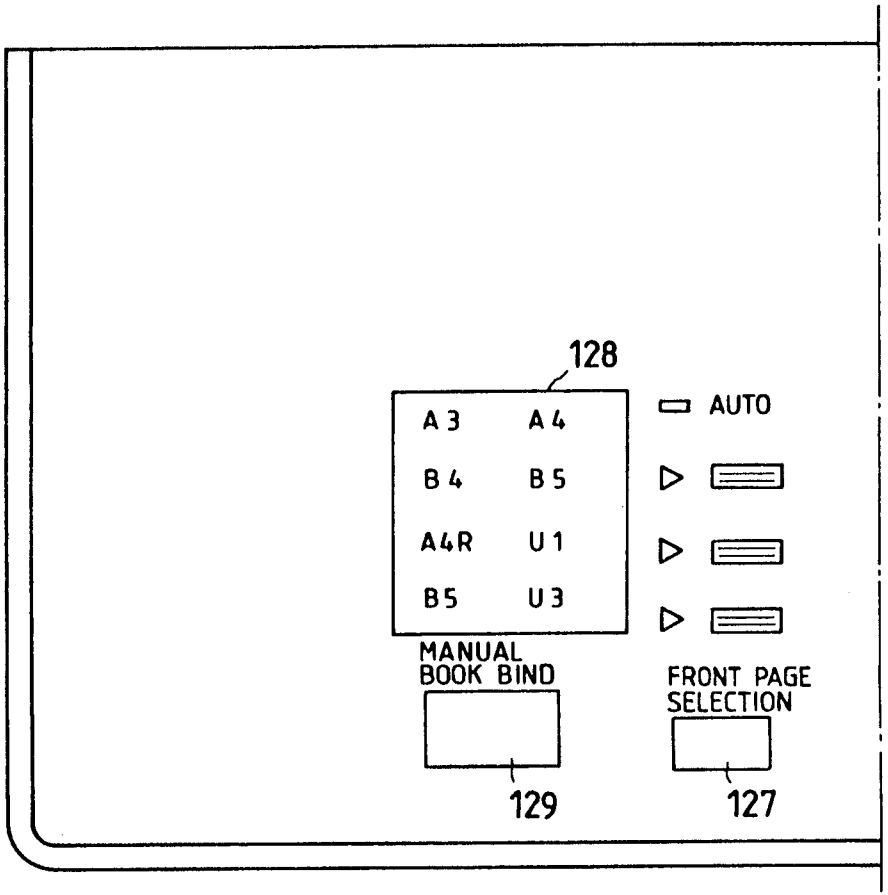

In FIG. 5D, a front sheet selection key 127 is depressed to select one of the upper front sheet cassette 2401, the intermediate front sheet cassette 2402, and the lower front sheet cassette 2403. When the book bind key 125 is depressed, an auto mode of a front sheet cassette indicator 128 is normally selected. However, the auto mode is not selected when transfer sheets are placed on the temporary store bins later or in the manual book bind mode. A manual book bind key 129 is depressed to manually bind a book.

Figure 6:
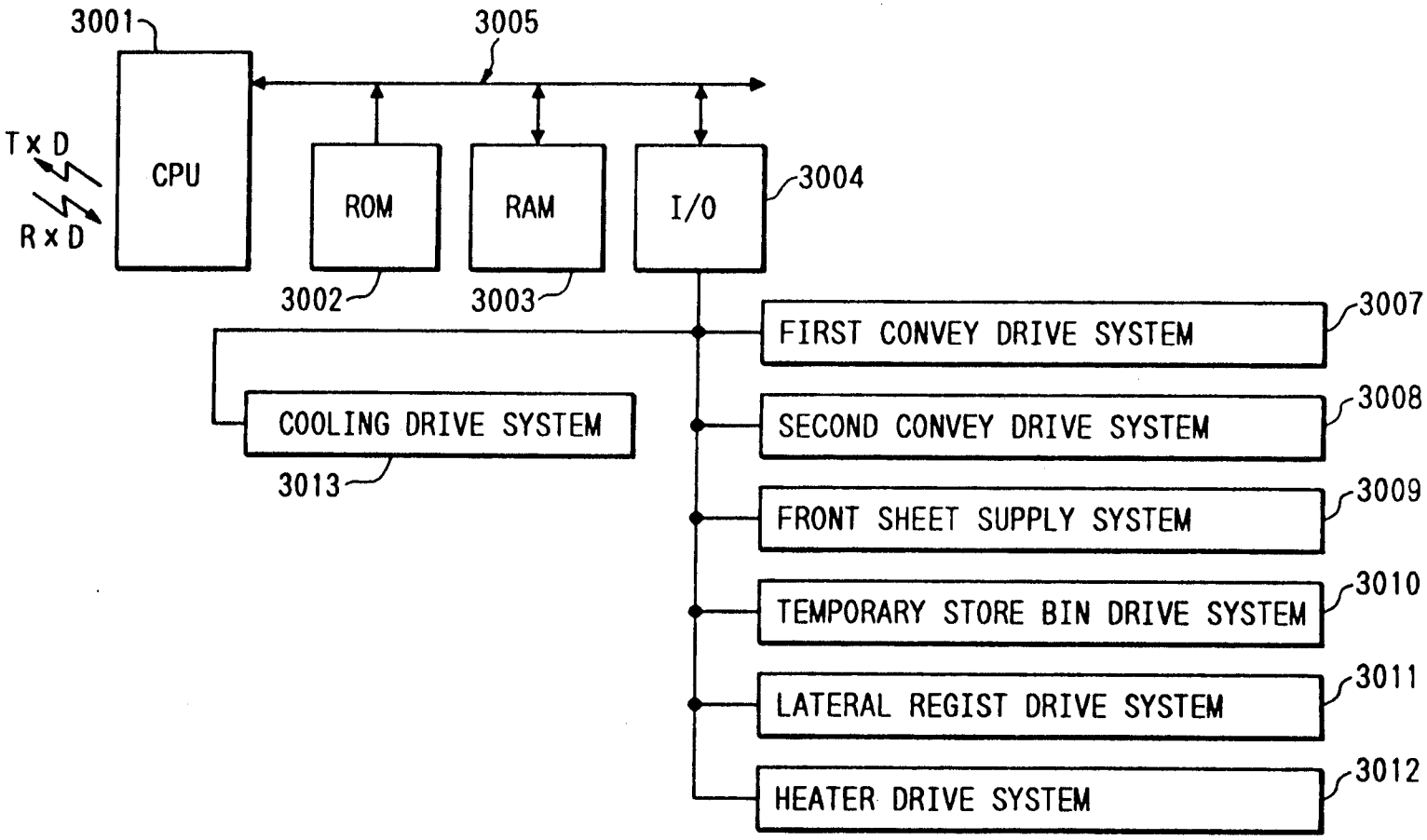
FIG. 6 is a block diagram showing a circuit arrangement of a control system of a book bind device according to the embodiment of the present invention.

FIG. 6 shows a circuit arrangement of a control system of the book bind device 2000 shown in FIG. 3.

In FIG. 6, a central processing unit (CPU) 3001 controls the overall device by executing a control sequence (to be described later). A read-only memory (ROM) 3002 prestores a control sequence to be executed by the CPU 3001. A random-access memory (RAM) 3003 stores various data such as arithmetic data of the CPU 3001, control data received from the copying machine 1000, and the like. An input/output interface (I/O) 3004 transfers control signals and operation signals to be exchanged between the CPU 3001 and the constituting units of the book bind device.

The ROM 3002, the RAM 3003, and the I/O 3004 are commonly connected to an address bus 3005, and information transfer control is performed upon an instruction from the CPU 3001. The I/O 3004 is connected to a first convey drive system 3007, a second convey drive system 3008, a front sheet supply system 3009, a temporary store bin drive system 3010, a lateral regist drive system 3011, a heater drive system 3012, and a cooling drive system 3013.

The first convey drive system 3007 comprises the motor, flapper, and the like associated with conveyance of a transfer sheet in the first convey unit 2100 shown in FIG. 2, and its drive circuit. The second convey drive system 3008 comprises the motor, flapper, and the like associated with conveyance of a transfer sheet in the second convey unit 2200 shown in FIG. 2, and its drive circuit.

The front sheet supply system 3009 comprises a motor for driving a mechanism for selecting a front sheet from the front sheet cassette 2400 shown in FIG. 2, and its drive circuit. The temporary store bin drive system 3010 comprises a motor shifting the temporary store bin 2300 shown in FIG. 2, and its drive circuit.

The lateral regist drive system 3011 comprises a motor for moving the lateral regist plate 2504 in the book binder 2503 shown in FIG. 3, and its drive circuit. The heater drive system 3012 comprises the heater in the heating unit 2505 in the book binder 2503 shown in FIG. 3, and a circuit for heating this heater. The cooling drive system 3013 comprises the cooling fan 2603 shown in FIG. 2, and its drive circuit. The CPU 3001 exchanges information with the CPU of the copying machine 1000 by serial communications.

Some pieces of information such as size information, copy sheet number information, and manual insertion information of a transfer sheet, post-treatment start information, and the like, which are input from the operation portion 1102 of the copying machine 1000 are transmitted in a communication format shown in FIG. 9. Information indicating that the book bind device is in a standby state (during a standby operation), information indicating that the book bind device is busy (under execution of a book bind operation), size information of a front sheet set in the front sheet cassette, information indicating the presence/absence of a front sheet in the cassette, information indicating a thickness of a front sheet, and abnormality information indicating a sheet or front sheet jam in the book bind device are transmitted from the CPU 3001 of the book bind device to the CPU 1101 of the copying machine main body.

The processing operations of the copying machine main body and the book bind device associated with the book bind treatment will be described below with reference to the flow charts shown in FIGS. 7A and 7B. In this embodiment, two copies of five A4-size original sheets are bound.

Figures 1, 7A:
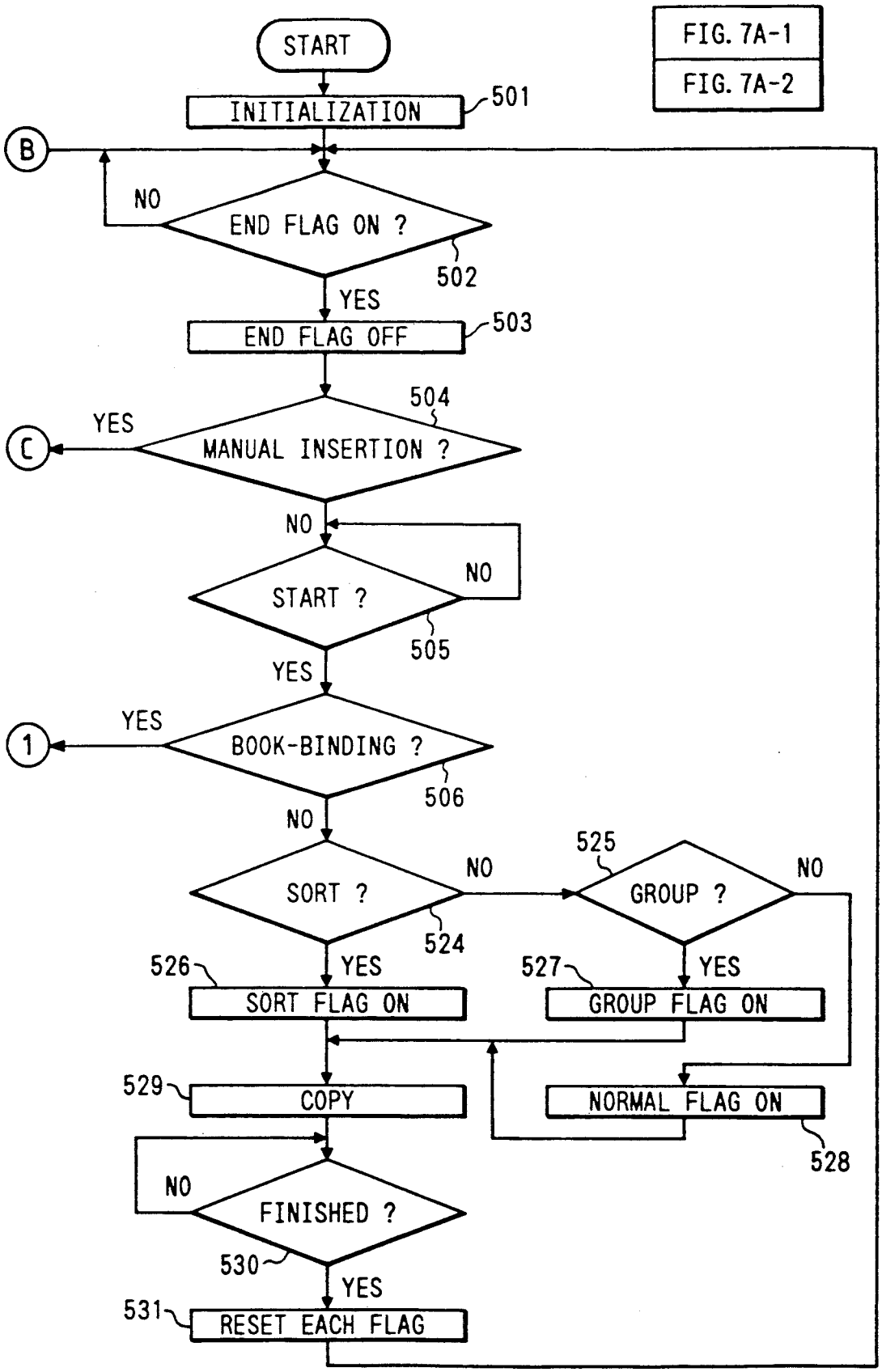
FIGS. 7A and 7B, and FIG. 8 are flow charts showing treatment operations executed by the copying machine.
Figures 2, 7A:
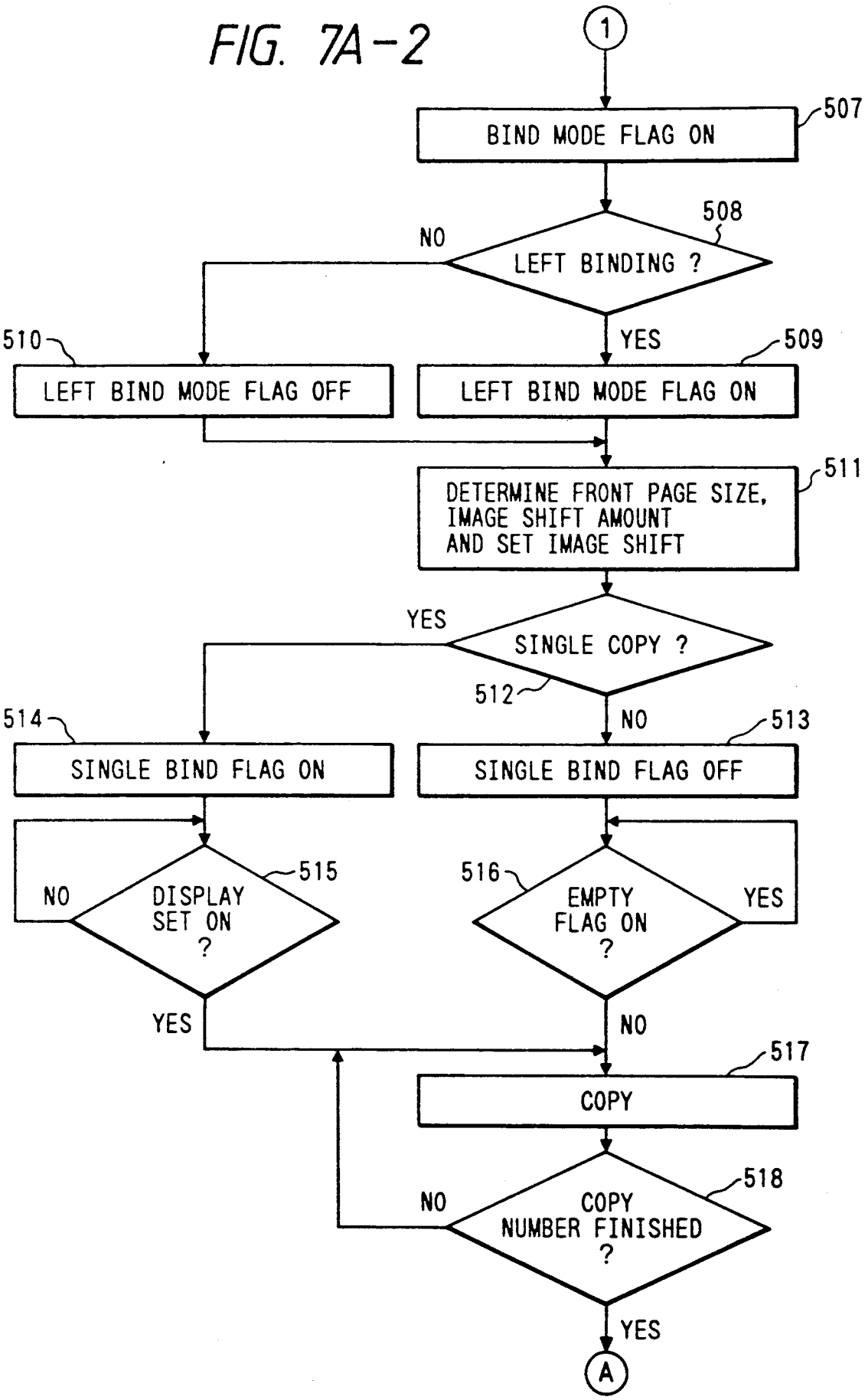
Figure 7B:
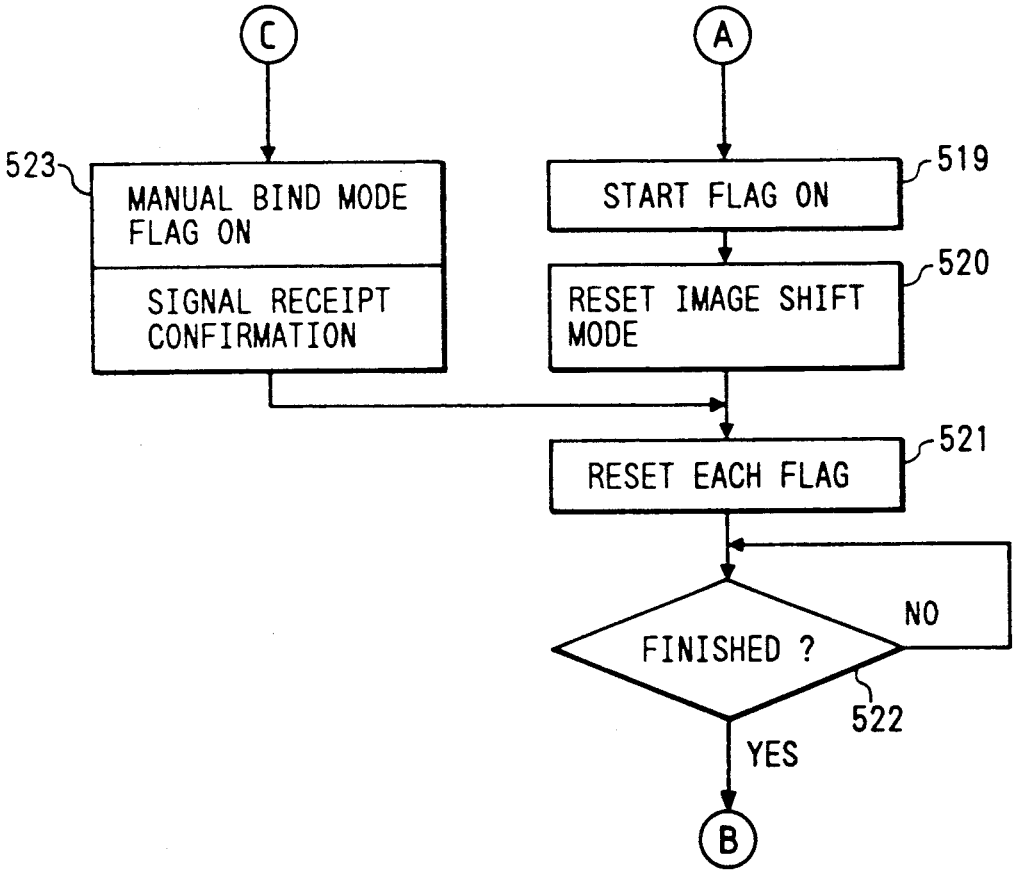

FIGS. 7A and 7B show control processing operations executed by the CPU 1101 of the copying machine main body.

(i-A) Multiple Copy Book Bind

As an initialization treatment (step 501 in FIG. 7A), it is confirmed that a voltage and a temperature of the copying machine main body reach predetermined values. Whether or not the original treatment device and the book bind device connected to the copying machine have completed end operations and are ready to start a copy operation is then confirmed by checking if an end flag is ON (step 502 in FIG. 7A). The end flag is flag information indicating a copy operation state. When this flag is ON, it indicates an operation state; when it is OFF, it indicates an operation end state. An ON/OFF state of the end flag is determined on the basis of operation information sent from the original treatment device and the book bind device to the copying machine main body.

In step 504, the level of a key input signal from the operation portion is checked to determine whether or not a book bind mode with an opened manual insertion tray is instructed. In this case, since the manual insertion book bind mode is not set, the flow advances to step 505 to wait for depression of the start key 104. When the book bind key 125 and the start key 104 are depressed by an operator, the book bind mode is selected, and the flow advances from step 506 to step 507. A bind mode flag indicating that the book bind mode is set is turned on, and this flag information is also sent to the book bind device.

Whether the right or left binding is designated in the book bind mode is determined on the basis of a command input from the bind direction select key 126 of the operation portion. If no designation input is made, the left bind mode is automatically set. In this case, the left bind mode is designated, and as a result, a left bind mode flag is turned on. This flag information is sent to the book bind device (steps 508 and 509). If the right bind mode is designated, the left bind mode flag is turned off (steps 508 and 510).

A proper front sheet is then selected on the basis of the sheet number and size of an original detected by the original treatment device. In this case, front sheets for one to five A4-size sheets per copy are selected for two copies of five A4-size original sheets. For example, since two copies of 25 A4-size original sheets exceed the number of transfer sheets which can be bound with a front sheet, the number of sheets to be divisionally copied and the number of sheets to be bound are respectively set to be 5. When 24 A4-size original sheets are to be bound, two ways of copy treatments, i.e., two copy treatments in units of 12 sheets and four copy treatments in units of six sheets, are available. In this embodiment, the copy treatments with the smaller numbers of times of copy operations and book bind treatments are selected. Data associated with the sizes and thicknesses of the front sheet and original which are set in this manner are written in communication data.

A glue margin according to the number of original sheets counted by the original treatment device 1001 is calculated in step 511. In this embodiment, the glue margin is set to be 10 mm when the number of original sheets is 1 to 5; it is set to be 12 mm when the number of original sheets is 5 to 10; and it is set to be 14 mm when the number of original sheets is 11 to 20. In order to define a glue margin region corresponding to the set glue margin on a transfer sheet, an original image shift record mode is set. An original image shift amount is variably set by the CPU 1101 by extracting data corresponding to the number of original sheets from a margin data table stored in the ROM 1103 in the same manner as in the glue margin.

In step 512, the number of copies to be bound is checked. If the number of copies to be bound is 1, a single bind flag is turned on; if the number of copies to be bound is two or more, the single bind flag is turned off. After it is confirmed in step 516 based on empty flag information in information transmitted from the book bind device that there are no transfer sheets on the temporary store bins in the book bind device, and after it is confirmed that there are transfer sheets corresponding to the front sheet size instructed in this state and the instructed front sheet size coincides with the original size, the set number of copies of original sheets are divisionally copied in the image shift mode.

Note that if it is detected that there are transfer sheets on the temporary store bins, an alarm display is made by the LCD 150 to instruct an operator to remove the transfer sheets.

When the copy operation of the original is completed in this copy treatment sequence, a start flag for instructing the book bind device to start a book bind operation is turned on, and the flag information is written in data to be transmitted to the book bind device (step 519 in FIG. 7B). After the above-mentioned transmission data is transmitted to the book bind device, the image shift mode is canceled, and the flags used in the copying machine are reset in a software manner (steps 520 and 521).

A control treatment on the side of the copying machine is completed as described above, and after the operation of the book bind device is completed (step 521), the flow returns to step 502 in FIG. 7A to set a copy command wait state for the next original.

(ii-A) Single Copy Book Bind

The same operations as in the above-mentioned multiple copy book bind treatment are performed except that, in FIG. 7A, after a single copy book bind mode is confirmed, it is detected that a front sheet is set in the book binder, and a copy operation is started (steps 512, 514, and 515).

(iii-A) Book Bind Operation Using Manual Insertion Tray

When a book bind mode using the manual insertion tray is instructed from the operation portion, this is detected by a judgement treatment in step 504 in FIG. 7A, and the flow advances to step 523 in FIG. 7B. In step 523, a manual bind mode flag in communication data is turned on. The number of sheets to be manually inserted input at the ten-key pad 106 of the operation portion and front sheet data selected and input by the front sheet selection key 127 are transmitted from the copying machine main body to the book bind device together with the manual bind mode flag information. After it is confirmed that this transmission information is received, the flags are reset to initial states, thus waiting for completion of the operation of the book bind device (steps 523, 521, and 522 in FIG. 7A).

(iv-A) Operation Mode Other Than Book Bind Mode

The book bind device can serve as a sorter since it has a plurality of bins. When a sorter mode is selected and input at the operation portion, a communication sort flag is turned on in the order from step 524 to step 525 in FIG. 7A, and a sorter mode command is sent to the book bind device.

If the number of copies is one, a heater is selected depending on a front sheet and the number of original sheets in a check operation of the single copy mode in step 512. In this case, since five A4-size sheets are to be bound, an A4-width heater is selected. Then, control of the lateral regist plate and a front sheet convey treatment are performed. Then, a front sheet set flag indicating that the front sheet is set in the book binder 2503 is turned on and this flag information is sent to the copying machine main body by a communication. It is then checked if the bind direction is set in the left bind mode.

Transfer sheets discharged from the copying machine main body pass through the single copy convey path 2103 in the book bind device, are reversed by a reverse roller 2108 in the third convey path 2104, and are then conveyed to the fourth convey path 2105. When the right bind mode is selected, the transfer sheets are conveyed from the single copy convey path 2103 to the fourth convey path 2105. The angle of a sheet supply flapper 2205 is controlled so that the transfer sheets fed to the book binder are sorted in the order of the first sheet, the second sheet, the third sheet, . . . . It is then checked if treatments corresponding to the number of original sheets are completed.

When the angle control of the sheet supply flapper 2205 is not completed yet, the control waits for completion of this control treatment. When the angle control of the sheet supply flapper 2205 is completed, a heating treatment and a compression treatment are performed in the same manner as in the multiple copy book bind operation, and the transfer sheets are then cooled until a temperature is decreased to 40° C. When cooling is completed, the end flag indicating that the book bind operation is ended is turned on, thus setting an initial state.

When transfer sheets are to be sorted in units of original groups, a group flag is turned on (steps 525 and 527 in FIG. 7A). When a normal sort treatment is to be performed, a normal flag is turned on (step 528), and a type of sort mode is informed to the book bind device by means of the above-mentioned flag information.

After the following operation is performed, initialization is performed, and the control waits for the next copy command (steps 529, 530, 531, and 502).

An operation for detecting the number of sheets to be divisionally copied associated with the present invention will be described below with reference to FIG. 8.

Figure 8:
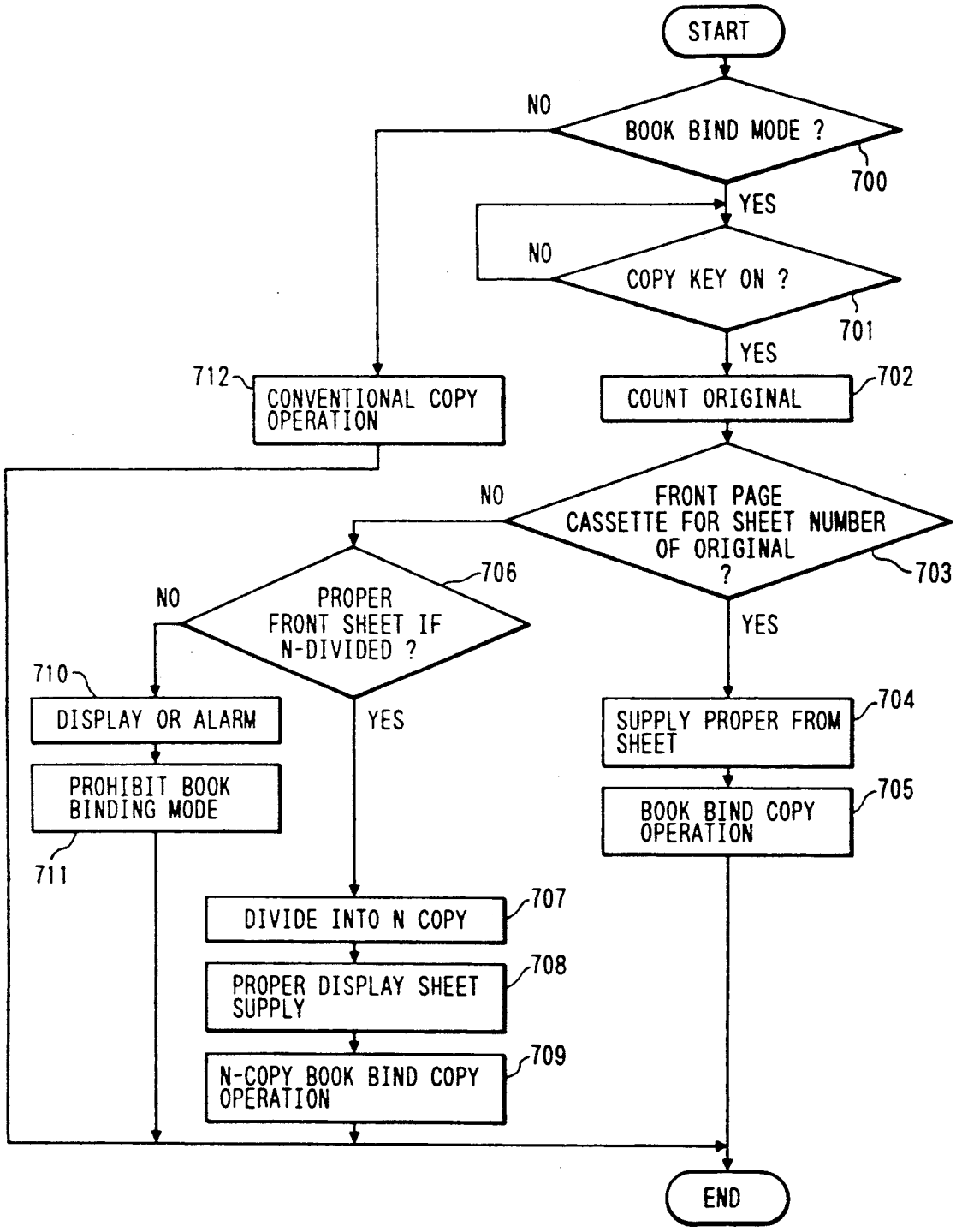

In FIG. 8, it is checked if the book bind key 125 is depressed (step 700). If NO in step 700, a conventional copy operation is performed (step 712), and a series of copy operations are completed.

If YES in step 700, however, the control is kept in a standby state until the copy start key 104 is depressed (step 701). After depression of the copy start key 104 is detected (step 701), the number of original sheets automatically counted by the original treatment device 1001 or the number of original sheets manually input by an operator using an original sheet number setting key 130 is read out from the RAM 1104 in step 702.

It is then checked in step 703 by comparing numerical values if a front sheet having a sheet number size capable of binding the readout number of original sheets is available from front sheets for one to five A4-size sheets per copy, front sheets for six to ten A4-size sheets per copy, and front sheets for eleven to twenty A4-size sheets per copy which are presently set in the book bind device. For example, when the number of original sheets is five, a front sheet for one to five A4-size sheets per copy is selected.

When the number of original sheets is twenty five, none of the above-mentioned front sheets can be used. The number of original sheets is divided by two, and a numerical value "11" obtained as the divided sheet number is compared with the numbers of sheets which can be bound of front sheets to search a proper front sheet. As a result, a front sheet for eleven to twenty A4-size sheets per copy is selected, and the type of the selected front sheet is instructed to the book bind device as a front sheet to be used in a book bind operation. In addition, "2" is set as the number of copies to be bound (step 707). When no front sheets for eleven to twenty A4-size sheets per copy are set in the book bind device, the original sheet number "25" is divided by a numerical value "3", and a front sheet for six to 10 A4-size sheets per copy is selected based on a numerical value "9" as a result of calculation.

Thereafter, a copy treatment of the original is performed in units of the divided copy sheet numbers detected based on the calculation result (steps 708 and 709). In this case, the original sheets may be divided in units of the divided copy sheet numbers, the corresponding number of copied sheets may be fed to the book bind means, and these operations may be repeated by the number of divisions. Alternatively, all the original sheets may be continuously read, the copied sheets may be guided to the exclusive tray to be distributed in units of the divided copy sheet numbers, and the divided bundles may be independently fed to the book bind means via the convey paths 2104 and 2105.

More specifically, when the number of original sheets is ten, five original sheets are read and copied, and the copied sheets are bound by the book bind means. Thereafter, the remaining five original sheets are read and copied, and the copied sheets are similarly bound. Alternatively, ten original sheets are continuously read, the copied sheets are stored in a tray while being classified in units of five sheets, and bundles of five sheets are bound by the book bind means.

In some cases, however, no proper front sheet may be bound by the divisional calculation treatment. For example, the number of original sheets is "5", and no front sheets for one to five A4-size sheets are set. In this case, it is determined in step 703 that the book bind treatment is disabled. Thus, a buzzer is caused to generate an alarm sound, and an alarm message "no proper front sheet" is displayed on the LCD (steps 706 to 710). In step 711, the book bind mode is prohibited. When the number of original sheets is increased or a front sheet cassette of a proper front sheet size is set in the book bind device, the prohibition mode is canceled.

Another embodiment of the present invention will be described in detail below with reference to FIG. 10.

Figure 10:
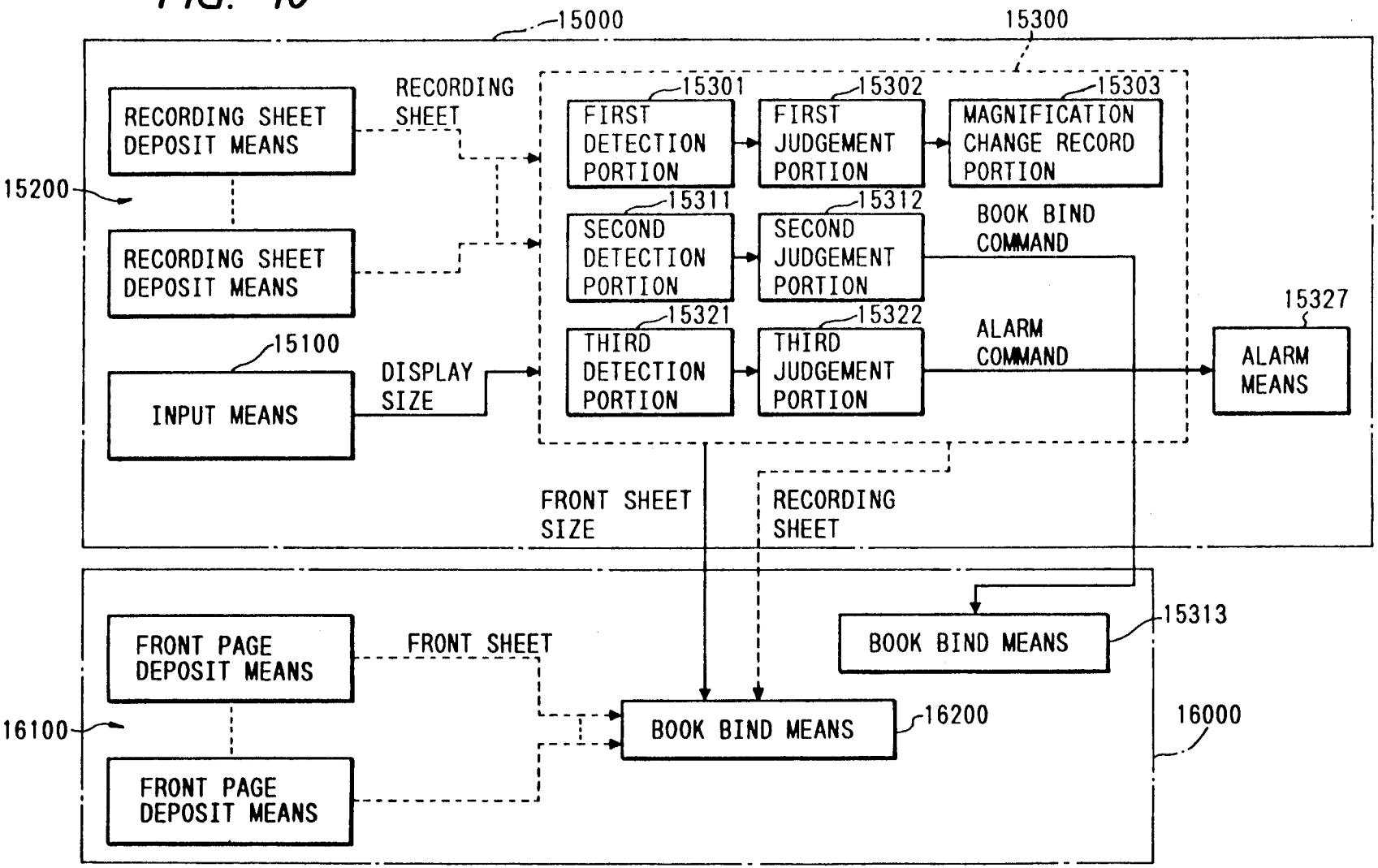
FIG. 10 is a block diagram showing a basic arrangement according to another embodiment of the present invention.

In FIG. 10, an image apparatus 15000 comprises an input means 15100 for inputting a size of a front sheet to be used in a book bind operation, a plurality of recording sheet deposit means 15200, detachable from the image recording apparatus, for depositing recording sheets having different sizes, and a recording means 15300 for selectively picking up a recording sheet having the same size as that input from the input means, and recording an image thereon.

A book bind mechanism 16000 comprises a plurality of front sheet deposit means 16100, and book bind means 16200 for picking up a front sheet having a size input from the input means and binding the recording sheets discharged from the recording means with the picked-up front sheet.

The recording means comprises a first detection portion 15301 for detecting the size of the original, a first judgement means 15302 for judging whether or not the detected original size is the same as the front sheet size input from the input means, and a magnification change recording portion 15303 for, when the judged result from the first judgement portion is negative, performing magnification change recording of the original on the recording sheets in correspondence with the size of recording sheets to be used in a recording operation.

Furthermore, the recording means comprises a second detection portion 15311 for detecting the sizes of recording sheets in the plurality of recording sheet deposit means, and a second judgement portion 15312 for judging whether or not the detected recording sheet sizes do not coincide with the front sheet size input from the input means, and the sizes of recording sheets are larger than the front sheet size. The book bind mechanism further comprises a sheet folding means 15313 for, when the judged result of the second judgement portion is affirmative, folding the recording sheet recorded by the recording means to have the same size as the front sheet size input from the input means. Since the detailed structure of the sheet folding means is described in U.S. Pat. No. 4,717,134, it can be used.

Furthermore, the recording means further comprises a third detection portion 15321 for detecting the sizes of the recording sheets in the plurality of recording sheet deposit means, and a third judgement portion 15322 for judging whether or not the detected recording sheet sizes coincide with the front sheet size input from the input means. The image recording apparatus further comprises an alarm means 15323 for, when the judged result from the third judgement means is negative, generating an alarm.

The second embodiment will be described below with reference to FIG. 4 although it shows a circuit arrangement of a control system of a copying machine 1000 shown in FIG. 2.

In FIG. 4, a CPU 1101, an operation portion 1102, a read-only memory (ROM) 1103, a random-access memory (RAM) 1104, and an input/output interface (I/O) 1105 are connected to a common bus. The CPU 1101 controls the overall copying machine. The CPU 1101 executes not only a normal copy treatment, but also a control procedure shown in FIGS. 7A and 7B and FIG. 11 in a book bind mode, thereby executing the following copy treatment associated with the second embodiment of the present invention.

a) A transfer sheet having the same size as the front sheet size selected by an operator is selected, and copy control for the selected transfer sheet is executed.

b) It is judged whether an original size coincides with the selected transfer sheet size. It is judged whether or not there are transfer sheets having the same size as the selected front sheet size, and the types of size of the presently set transfer sheets are detected.

c) When the original size does not coincide with the selected transfer sheet size, magnification change recording is performed in correspondence with the transfer sheet size.

d) When the transfer sheet size is larger than the selected front sheet size, an operation command for a treatment for folding a blank portion of a copied transfer sheet in correspondence with the front sheet size is issued.

e) When there are no transfer sheets suitable for the selected front sheet size, an alarm is generated by means of a display or sound, and a book bind treatment is prohibited.

The CPU 1101 operates as the first, second, and third judgement portions. The operation portion 1102 has various input keys (to be described later), and inputs information associated with the copy treatment. The ROM 1103 stores a control sequence executed by the CPU 1101, and also stores parameters used in an arithmetic treatment of the CPU 1101. The RAM 1104 temporarily stores arithmetic data of the CPU 1101 and image data read from an original.

The I/O 1105 is connected to an original treatment device 1001, a copy mechanism 1106 in the copying machine, and a book bind device 2000. Information is exchanged between these devices and the CPU 1101.

The operation of the second embodiment will be described below with reference to FIGS. 7A and 7B showing control treatment operations executed by the CPU 1101 of the copying machine main body.

(i-A) Multiple Copy Book Bind

As an initialization treatment (step 501 in FIG. 7A), it is confirmed that a voltage and a temperature of the copying machine main body reach predetermined values. Whether or not the original treatment device and the book bind device connected to the copying machine have completed operations and are ready to start a cop operation is then confirmed by checking if an end flag is ON (step 502). The end flag is flag information indicating a copy operation state. When this flag is ON, it indicates an operation state; when it is OFF, it indicates an operation end state. An ON/OFF state of the end flag is determined on the basis of operation information sent from the original treatment device and the book bind device to the copying machine main body.

In step 504, the level of a key input signal from the operation portion is checked to determine whether or not a book bind mode with an opened manual insertion tray is instructed. In this case, since the manual insertion book bind mode is not set, the flow advances to step 505 to wait for depression of the start key 104. When the book bind key 125 and the start key 104 are depressed by an operator, the book bind mode is selected, and the flow advances from step 506 to step 507. A bind mode flag indicating that the book bind mode is set is turned on, and this flag information is also sent to the book bind device.

Whether the right or left binding is designated in the book bind mode is determined on the basis of a command input from the bind direction select key 126 of the operation portion. If no designation input is made, the left bind mode is automatically set. In this case, the left bind mode is designated, and as a result, a left bind mode flag is turned on. This flag information is sent to the book bind device (steps 508 and 509). If the right bind mode is designated, the left bind mode flag is turned off (steps 508 and 510). Data associated with a front sheet size and thickness input by the front sheet selection key 127 are written in communication data. For example, in the case of two copies of A4-size five original sheets of this case, a front sheet for one to five A4-size sheets per copy is selected.

The CPU 1101 of the copying machine main body checks if there are transfer sheets having the same size as the front sheet size input by the front sheet selection key 127. As described above, output levels of microswitches attached to the copying machine main body, which are in contact with the transfer sheet cassettes, are detected to identify the types of transfer sheet cassette.

After it is confirmed that there are transfer sheets having the same size as the front sheet size input by the front sheet selection key 127, a glue margin according to the number of original sheets is calculated in step 511. In this embodiment, the glue margin is set to be 10 mm when the number of original sheets is 1 to 5; it is set to be 12 mm when the number of original sheets is 5 to 10; and it is set to be 14 mm when the number of original sheets is 11 to 20. In order to define a glue margin region corresponding to the set glue margin on a transfer sheet, an original image shift record mode is set. An original image shift amount is variably set by the CPU 1101 by extracting data corresponding to the number of original sheets from a margin data table stored in the ROM 1103 in the same manner as in the glue margin. After it is confirmed in step 516 based on empty flag information in information transmitted from the book bind device that there are no transfer sheets on the temporary store bins in the book bind device, and after it is confirmed that there are transfer sheets corresponding to the front sheet size instructed in this state and the instructed front sheet size coincides with the original size, the set number of copies of original sheets are divisionally copied in the image shift mode.

Note that if it is detected that there ar transfer sheets on the temporary store bins, an alarm display is made by the LCD 150 to instruct an operator to remove the transfer sheets.

When the copy operation of the original is completed in this copy treatment sequence, a start flag for instructing the book bind device to start a book bind operation is turned on, and the flag information is written in data to be transmitted to the book bind device (step 519 in FIG. 7B). After the above-mentioned transmission data is transmitted to the book bind device, the image shift mode is canceled, and the flags used in the copying machine are reset in a software manner (steps 520 and 521).

A control treatment on the side of the copying machine is completed as described above, and after the operation of the book bind device is completed (step 521), the flow returns to step 502 in FIG. 7A to set a copy command wait state for the next original.

The single copy book bind operation, the book bind operation using the manual insertion tray, and the like are performed in the same manner as in the first embodiment although a description thereof is omitted.

Figure 11:
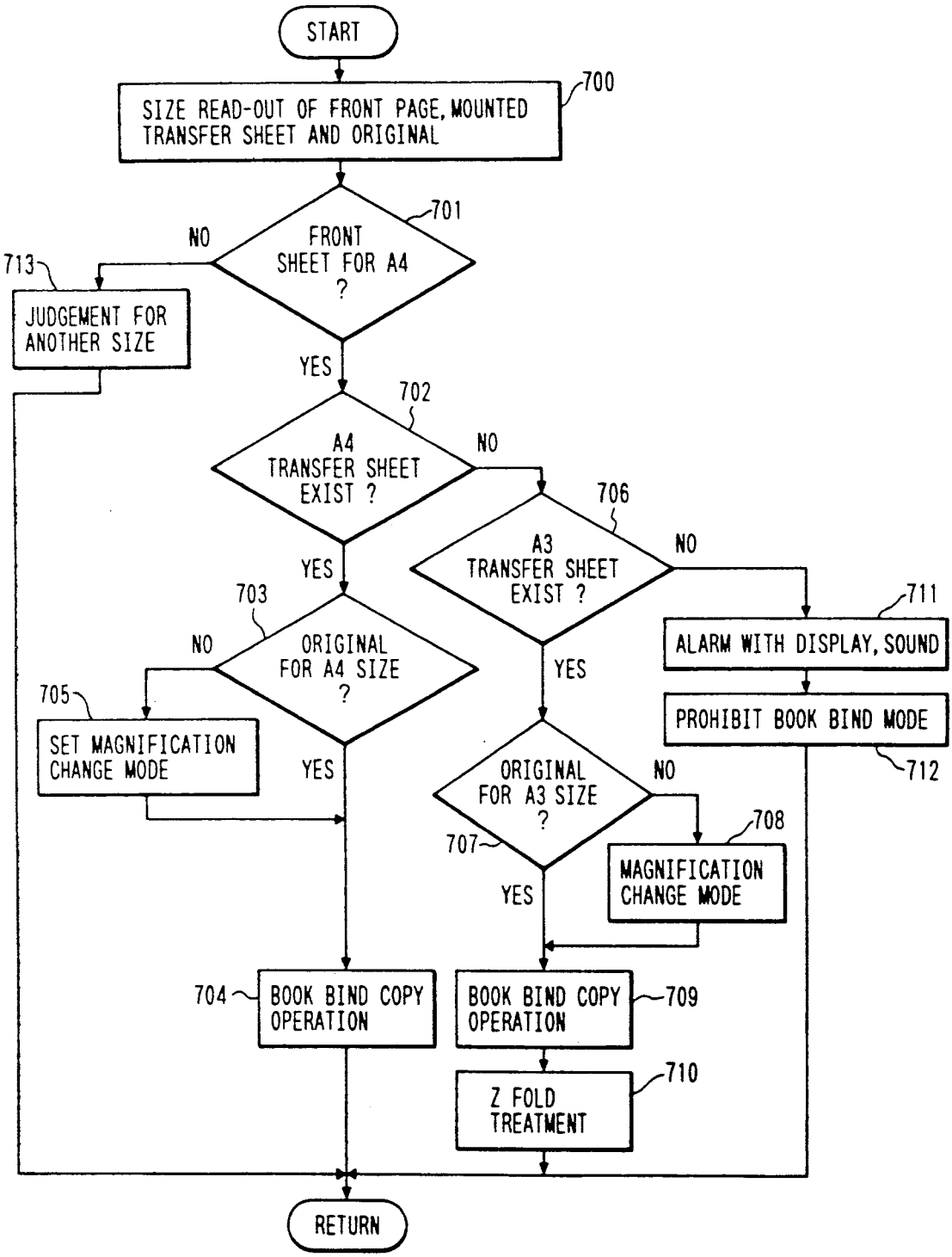
FIG. 11 is a flow chart showing a treatment operation executed in a copying machine.

An operation for selecting a transfer sheet associated with a copy operation according to the second embodiment of the present invention will be described below. FIG. 11 shows a detailed control sequence of a copy treatment in step 517 shown in FIG. 7A.

a) When a selected front sheet size is A4 and a transfer sheet size is A4:

In FIG. 11, data of a front sheet size selected by an operator is read out from the RAM 1104, thereby detecting that the front sheet size is A4 (steps 700 and 701). When the above-mentioned front sheet selection key 127 is not depressed, a default size is selected. It is detected in a judgement treatment in step 702 that an A4-size transfer sheet cassette is loaded in the copying machine main body. In step 705, a transfer sheet is picked up from the A4-size transfer sheet cassette, and an original image is directly copied thereon.

b) When a selected front sheet size is A4, an original size is A3, and a transfer sheet size is A4:

In FIG. 11, data of a front sheet size selected by an operator is read out from the RAM 1104, thereby detecting that the front sheet size is A4 (steps 700 and 701). It is detected in the judgement treatment in step 702 that an A4-size transfer sheet cassette is loaded in the copying machine main body. It is detected in step 703 that an original has an A3 size larger than an A4 size. In step 705, a magnification change mode is set, and thereafter, in step 706, an A3-size original image is reduced and copied on an A4-size transfer sheet.

c) When a selected front sheet size is A4, an original size is A3, and a transfer sheet size is A3:

It is detected in the judgement treatment in step 702 that an A4-size transfer sheet cassette is not loaded in the copying machine main body. In step 706, it is detected that an A3-size transfer sheet cassette larger than the A4 size is loaded in the copying machine main body. In step 707, it is detected that an original has an A3 size larger than an A4 size, and the sizes of the original and the transfer sheet coincide with each other. Thereafter, in step 709, an A3-size original image is directly copied on the A3-size transfer sheet.

Note that when the sizes of the transfer sheet and the original are different from each other, the magnification change mode is set to perform a magnification change copy operation in correspondence with the transfer sheet size (steps 708 and 709). If it is detected in this sequence that the transfer sheet size is larger than the front sheet size, the copied transfer sheet is folded in a Z shape by the sheet folding means in step 710.

d) When a selected front sheet size is A4, an original size is B5, and a transfer sheet size is B5:

If it is detected in steps 702 and 706 in the order named that there are no transfer sheets equal to or larger than the A4 size, an alarm sound is generated by a buzzer, or an alarm message is displayed on an LCD. Thereafter, a book bind mode is prohibited (steps 711 and 712).

In this embodiment, a case has been exemplified wherein an A4-size front sheet is selected. The same treatments as described above can be performed when front sheets of other sizes are selected, and a detailed description thereof will be omitted.

As described above, according to this embodiment, even when the size of a copied transfer sheet is larger than a selected front sheet size, it is folded in a Z shape by the sheet folding means, thus allowing a book bind operation.

Even when the sizes of a transfer sheet and an original are different from each other, an original image is automatically copied in a magnification change mode. Therefore, various book bind treatments according to front sheet sizes can be performed, and operation labor of an operator can be reduced.

Furthermore, when there are no transfer sheets matching with a front sheet size, an alarm is generated, and a copy treatment and a book bind treatment are prohibited. Therefore, not only an operation error of an operator can be detected, but also a wasteful copy treatment due to a key input error can be prevented.

What is claimed is:

1. An image forming apparatus having a book binding mechanism for performing a book bind operation using front sheets of a plurality of sizes which can bind a bundle of sheet members recorded by said image forming apparatus, and have limitations on the numbers of sheet members to be bound, comprising:

output means for outputting sheet number data according to a bundle of sheet members;

judge means for judging whether or not the sheet number data output from said output means is larger than a range of the limitation;

detect means for, when the judged result from said judge means is affirmative, dividing the sheet number data, and detecting a divided sheet number value which falls within the range of the limitation; and control means for controlling to perform a book bind operation in units of the sheet numbers detected by said detect means.

2. An apparatus according to claim 1, wherein one of the plurality of sizes of the front sheets can be selected, and a number of divisions is determined in comparison with the plurality of sizes of the front sheets.

3. An apparatus according to claim 2, wherein said control means controls record means to perform image recording in units of the sheet numbers detected by said detect means.

4. An apparatus according to claim 2, wherein said control means controls distribution means to distribute the sheet materials in units of the sheet numbers detected by said detect means.

5. An apparatus according to claim 1, further comprising alarm means for, when the divided sheet number cannot fall within the range of the limitation, prohibiting a book bind treatment of said book binding mechanism.

6. An apparatus according to claim 3, wherein said recording means copies an original image on the sheet member, and said output means comprises count means for counting the number of original sheets.

7. An apparatus according to claim 1, further comprising:

input means for inputting a size of a front sheet to be bound;

a plurality of sheet member deposit means, for respectively depositing recording sheets having different sizes;

record means for selectively picking up the sheet members having a size according to the size input from said input means, and recording images thereon;

a plurality of front sheet deposit means for respectively depositing front sheets having different sizes; and book bind means for selectively picking up a front sheet having a size input from said input means, and binding the sheet members discharged from said record means with the selected front sheet.

8. An apparatus according to claim 7, wherein said record means comprises a first detection portion for detecting a size of the original, a first judgement portion for judging whether the detected size of the original is the same as a front sheet size input from said input means, and a magnification change recording portion for, when the judged result from said first judgement portion is negative, performing magnification change recording of the original on the sheet members in correspondence with the size of the sheet members to be recorded.

9. An apparatus according to claim 7, wherein said record means comprises a second detection portion for detecting sizes of sheet members in said plurality of sheet member deposit means, and a second judgement portion for judging whether or not the detected sizes of the sheet members do not coincide with the front sheet size input from said input means and the sizes of the sheet members are larger than the front sheet size, and said image forming apparatus or said book binding mechanism further comprises sheet folding means for, when the judged result from said second judgement means is affirmative, folding the sheet member recorded by said record means to have the same size as the front sheet size input from said input means.

10. An apparatus according to claim 7, wherein said record means comprises a third detection portion for detecting sizes of sheet members in said plurality of sheet member deposit means, and a third judgement portion for judging whether or not the detected sizes of the sheet members coincide with the front sheet size input from said input means, and said apparatus further comprises alarm means for, when the judged result of said third judgement portion is negative, generating an alarm.

11. An image forming apparatus with a book binding mechanism comprising:

input means for inputting a size of a front sheet to be bound;

a plurality of sheet member deposit means for respectively depositing sheet members having different sizes;

record means for selectively picking up the sheet members having a size according to the size input from said input means, and recording an image thereon;

a plurality of front sheet deposit means for respectively depositing front sheets having different sizes; and book bind means for selectively picking up a front sheet having a size input from said input means, and binding the sheet members discharged from said record means with the selected front sheet.

12. An apparatus according to claim 11, wherein said record means comprises a first detection portion for detecting a size of the original, a first judgement portion for judging whether the detected size of the original is the same as a front sheet size input from said input means, and a magnification change recording portion for, when the judged result from said first judgement portion is negative, performing magnification change recording of the original on the sheet members in correspondence with the size of the sheet members to be recorded.

13. An apparatus according to claim 11, wherein said record means comprises a second detection portion for detecting sizes of sheet members in said plurality of recording sheet deposit means, and a second judgement portion for judging whether the detected sizes of the sheet members are larger than the front sheet size input from said input means, and said image forming apparatus or said book binding mechanism further comprises sheet folding means for, when the judged result from said second judgement means is affirmative, folding the sheet member recorded by said record means to have the same size as the front sheet size input from said input means.

14. An apparatus according to claim 11, wherein said record means comprises a detection portion for detecting sizes of sheet members in said plurality of sheet member deposit means, and a judgement portion for judging whether the detected sizes of the sheet members coincide with the front sheet size input from said input means, and said apparatus further comprises alarm means for, when the judged result of said judgement portion is negative, generating an alarm.

* * * * *

UNITED STATES PATENT AND TRADEMARK OFFICE

CERTIFICATE OF CORRECTION

PATENT NO. : 5,140,380

DATED : August 18, 1992

INVENTOR(S) : NAKAMURA, et al.

It is certified that error appears in the above-identified patent and that said Letters Patent is hereby corrected as shown below:

On the title page

[56] REFERENCES CITED

"4,143,672" should read --4,134,672--.
"Acquavana" should read --Acquaviva--.

IN THE DRAWINGS:

FIGURE 5A
"PIE-HEAT" should read --PRE-HEAT--.

FIGURE 5C
"SAQUENCE" should read --SEQUENCE--.

COLUMN 15

Line 46, "cop" should read --copy--.

COLUMN 16

Line 46, "ar" should read --are--.

Signed and Sealed this

Twenty-sixth Day of October, 1993

Bruce Lehman

*Attest:*

BRUCE LEHMAN

*Attesting Officer*

*Commissioner of Patents and Trademarks*